US006328109B1

(12) United States Patent
Pringle et al.

(10) Patent No.: US 6,328,109 B1
(45) Date of Patent: Dec. 11, 2001

(54) DOWNHOLE VALVE

(75) Inventors: Ronald E. Pringle, Houston; Clay W. Milligan, Jr., Missouri City; Dennis M. Read, Manvel, all of TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/713,049

(22) Filed: Nov. 15, 2000

Related U.S. Application Data

(60) Provisional application No. 60/165,680, filed on Nov. 16, 1999.

(51) Int. Cl.[7] ..... E12B 34/10

(52) U.S. Cl. ..... 166/373; 166/321; 166/332.8

(58) Field of Search ..... 166/373, 374, 166/321, 323, 331, 332.2, 332.8; 251/298, 360, 363

(56) References Cited

U.S. PATENT DOCUMENTS

| | | |
|---|---|---|
| 2,849,207 | 8/1958 | Conrad . |
| 2,912,216 | 11/1959 | Conrad . |
| 2,931,384 | 4/1960 | Clark . |
| 2,952,438 | 9/1960 | Conrad et al. . |
| 4,134,455 | 1/1979 | Read . |
| 4,154,303 | 5/1979 | Fournier . |
| 4,185,690 | 1/1980 | Kinney . |
| 4,393,930 | 7/1983 | Ross et al. . |
| 4,457,376 | 7/1984 | Carmody et al. . |
| 4,457,379 | 7/1984 | McStravick . |
| 4,541,484 | 9/1985 | Salerni et al. . |
| 4,566,478 | 1/1986 | Deaton . |
| 4,617,960 | 10/1986 | More . |
| 4,624,317 | 11/1986 | Barrington . |
| 4,632,187 | 12/1986 | Deaton . |
| 4,691,775 | 9/1987 | Lustig et al. . |
| 4,694,903 | 9/1987 | Ringgenberg . |
| 4,716,968 | 1/1988 | Pringle . |
| 4,813,481 | 3/1989 | Sproul et al. . |
| 4,846,281 | 7/1989 | Clary et al. . |
| 5,137,090 | 8/1992 | Hare et al. . |
| 5,188,182 | 2/1993 | Echols, III et al. . |
| 5,188,183 | 2/1993 | Hopmann et al. . |
| 5,310,005 | 5/1994 | Dollison . |
| 5,417,285 | 5/1995 | Van Buskirk et al. . |
| 5,479,986 | 1/1996 | Gano et al. . |
| 5,765,641 | 6/1998 | Shy et al. . |
| 5,803,173 | 9/1998 | Fraser, III et al. . |
| 5,947,204 | 9/1999 | Barton . |
| 5,990,051 | 11/1999 | Ischy et al. . |

FOREIGN PATENT DOCUMENTS

| | | |
|---|---|---|
| 2073288 | 10/1981 | (GB) . |
| 2110741 | 6/1983 | (GB) . |
| 2245913 | 1/1992 | (GB) . |
| WO 97/28349 | 8/1997 | (WO) . |

*Primary Examiner*—William Neuder
(74) *Attorney, Agent, or Firm*—Trop, Pruner & Hu P.C.

(57) ABSTRACT

The invention is a downhole valve that includes a body, a flow tube assembly that includes an upper tube member and a lower tube member, and a flapper valve. The flapper valve is pivotally attached to the body and is positioned between the upper tube member and the lower tube member when the flapper valve is in a closed position that blocks fluid flow in an internal bore of the body. The flapper valve is moved from the closed position to an open position in response to an upward movement of the upper tube member and the lower tube member. When the flapper valve pivots to the open position, the lower tube member moves adjacent to and forms a seal with the upper tube member, forming an unobstructed internal bore.

54 Claims, 22 Drawing Sheets

DOWNHOLE VALVE

This application claims priority from U.S. Provisional Patent Application No. 60/165,680, filed Nov. 16, 1999.

BACKGROUND OF THE INVENTION

Prior to the commencement of production in a wellbore, it is important to test the integrity and the connections of downhole equipment and tubing. Leaks, faulty connections, or faulty equipment can lead to hydrocarbon losses during production and potentially dangerous and life-threatening situations for operators at the surface of a well. To lessen the danger, a pressure test is normally performed in which the tubing (e.g., production tubing) or drillpipe is pressurized from the surface and any leaks or faulty connections are detected by a loss of pressure as measured by a gauge also located at the surface. To successfully accomplish this test, the tubing or drillpipe must be plugged at some point downhole and be sealed from a selected formation.

The types of devices previously used to plug the tubing or pipe downhole include closed formation tester valves and tubing tester valves. Flapper valves have also been utilized for such a purpose, as illustrated in U.S. Pat. No. 4,134,455 issued to Read, U.S. Pat. No. 4,694,903 issued to Ringgenberg, U.S. Pat. No. 5,137,090 issued to Hare et al., and U.S. Pat. No. 5,188,182 issued to Echols et al. The flapper valves disclosed in the above referenced patents are generally designed to seal against pressure adjacent the upper side (e.g., pressure from the uphole side) of the flapper valve.

The ability to seal against both uphole and downhole pressure is important because pressure may accumulate in the wellbore underneath the downhole plug. Therefore, it is desirable that a flapper valve be capable of withstanding not only pressure on its upper side generated by the pressure tests, but also pressure on its underside generated by the production fluids or downhole environment.

Additionally, pressure tests are typically conducted several times in sequence, generally each time additional tubing or drillpipe has been added to a drillstring and inserted downhole. The flapper valve must maintain its sealing engagement to the relevant tubing or drillpipe throughout each of the pressure tests in order to preserve the accuracy of each test. Once the pressure tests are completed and the wellbore is ready for production, it is necessary to remove, at least partially, the downhole valve or plug in order to pass other downhole tools through the drillpipe or tubing, or to allow production fluids to flow up to the surface through the tubing or drillpipe. It is preferable to completely remove the downhole valve or plug from the bore of the tubing or drillpipe so that the downhole tools and production fluids can pass and flow freely and without obstruction.

Attempts have been made to design a downhole plug that provides for a clear bore when the valve is opened. However, most plugs (such as those in the aforementioned patents) include parts (e.g., valve seats or internal tubing) that remain in the bore after the flapper has been removed or opened. Parts that remain in the bore may obstruct the passage of tools and the flow of fluids through the bore. It is therefore desirable to provide a downhole valve which enables the complete removal of the flapper valve from the bore of the relevant body at the appropriate time and which leaves such bore free of obstructions after use.

SUMMARY OF THE INVENTION

One aspect of the invention is a downhole valve comprising a body and a flow tube assembly positioned within the body. The flow tube assembly comprises an upper tube member and a lower tube member. A flapper valve is operatively attached to the flow tube assembly and is adapted to move from a closed position to an open position. When the flapper valve is in the closed position, the flapper valve is sealingly positioned between the upper and lower tube members. When the flapper valve is moved to the open position, the flapper valve is enclosed in a recess in the body. The movement of the flapper valve is in response to an upward movement of the upper and lower tube members so that after the flapper valve is enclosed in the recess, the upper and lower tube members move into a cooperative engagement with each other to form a substantially unobstructed internal bore.

Another aspect of the invention is a method of retractably sealing a bore of a body. The method comprises pivotally attaching a flapper valve to the body. A top surface of the flapper valve sealingly engages an upper tube member when the flapper valve is in a closed position. A bottom surface of the flapper valve sealingly engages a lower tube member when the flapper valve is in the closed position. The flapper valve is moved from the closed position to an open position in response to a plurality of pressure cycles by slidably moving the upper tube member and the lower tube member upward until the flapper valve is enclosed in a recess in the body and the upper tube member cooperatively engages the lower tube member.

Other aspects and advantages of the invention will be apparent from the following description and the appended claims.

DETAILED DESCRIPTION

Description of an Embodiment of the Downhole Valve

Figure 3A:
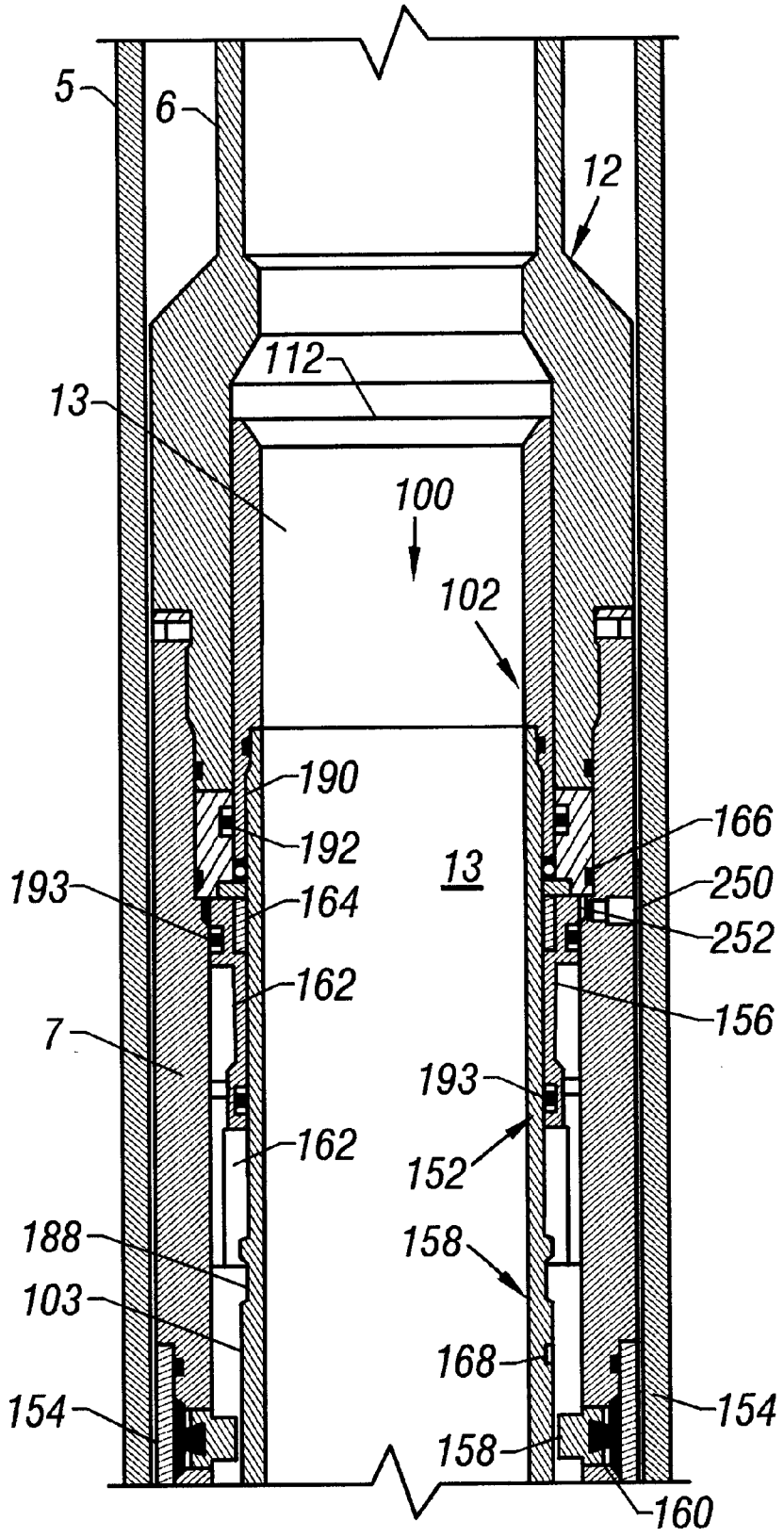
FIG. 3A is a cross-sectional view of an embodiment of a retractable valve with a flapper valve in an open position and a flow tube assembly in a tube engaging position.
Figure 3B:
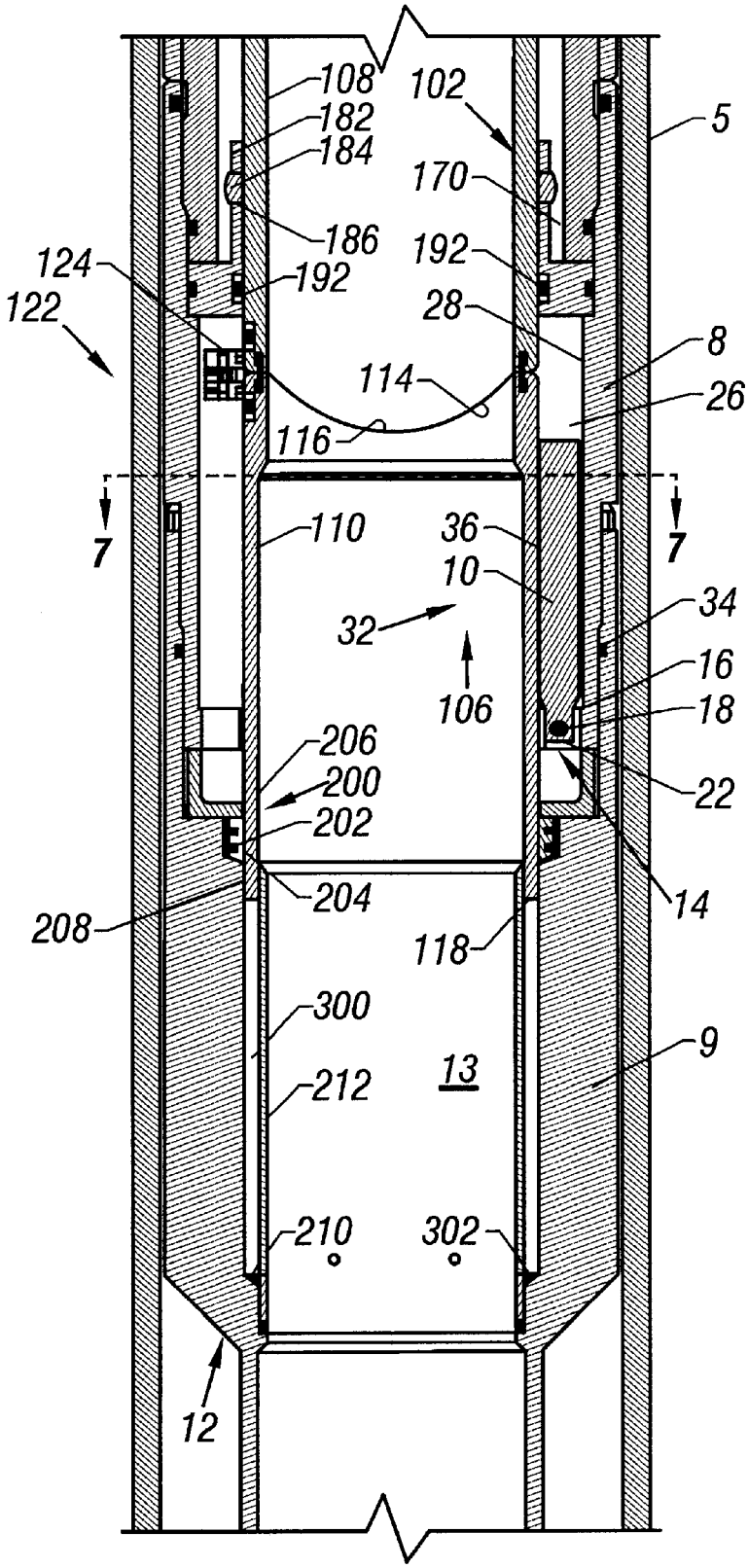
FIG. 3B is a cross-sectional view of an embodiment of a retractable valve with a flapper valve in an open position and a flow tube assembly in a tube engaging position.
Figure 4:
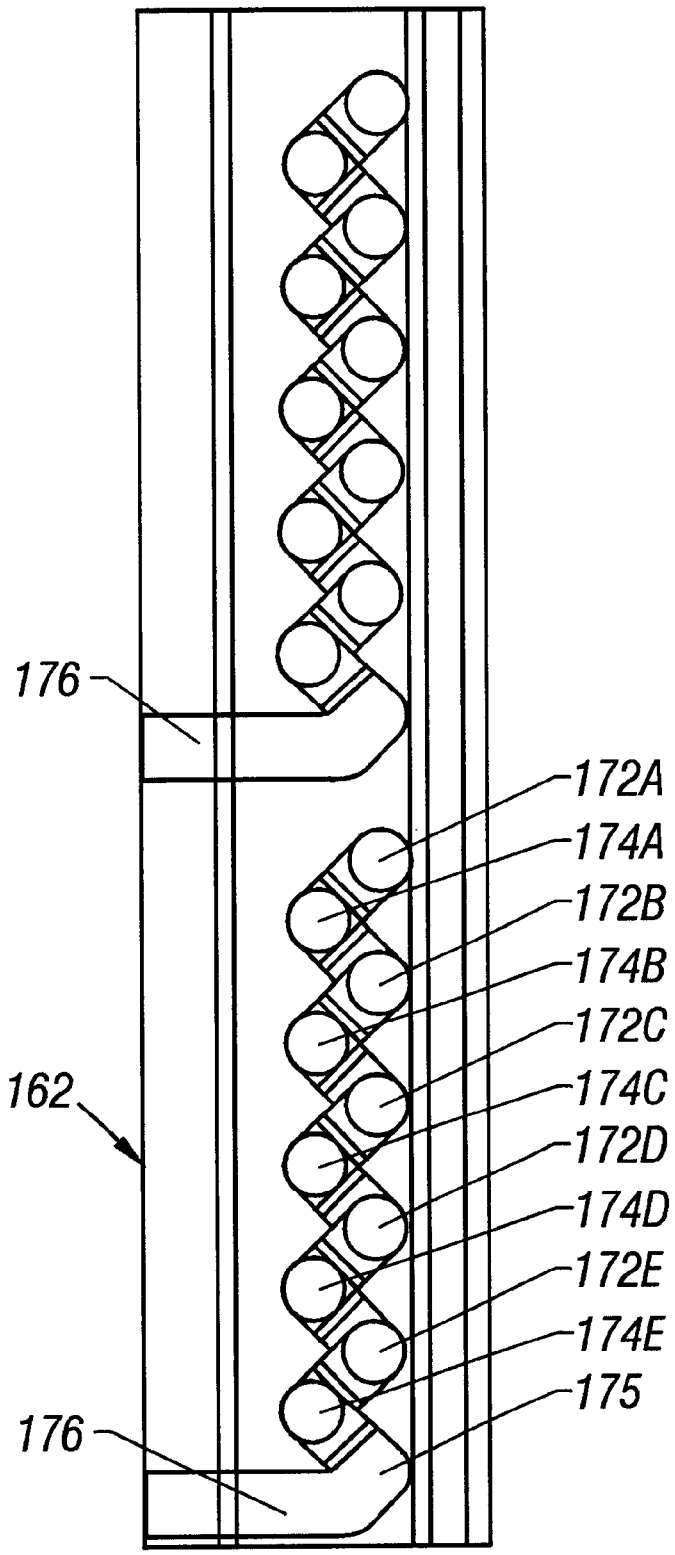
FIG. 4 is a schematic view of indexer slot sets of an indexing system of an embodiment of the invention.
Figure 5:
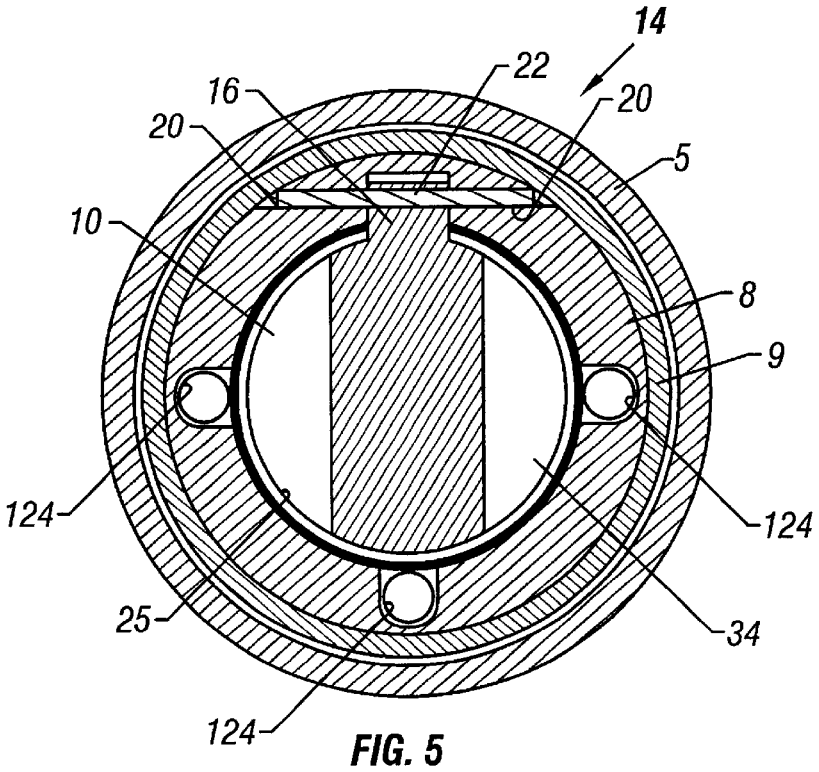
FIG. 5 is a cross-sectional view taken along line V—V of FIG. 2B.
Figure 6:
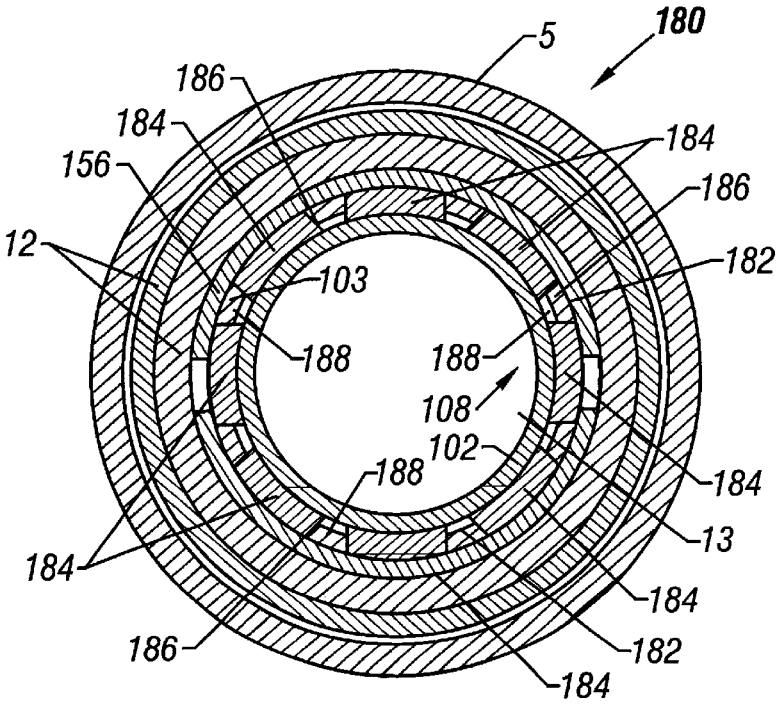
FIG. 6 is a cross-sectional view taken along line VI—VI of FIG. 2B.

A flapper valve of an embodiment of the invention is generally illustrated as reference numeral 10 in FIGS. 1–8. In one aspect of the invention, the flapper valve 10 is part of a downhole or retractable valve 100. Referring to FIG. 2B, the flapper valve 10 acts to control a flow of fluids through an internal bore 13 of a flapper housing 8 disposed within a well casing 5. The flapper housing 8 is a part of a tool body 12 of the retractable valve 100. Referring to FIGS. 2B and 5, the flapper valve 10 is pivotally connected to the flapper housing 8 with a pivoting mechanism 14. In an embodiment of the invention, pivoting mechanism 14 comprises an extension (16 in FIG. 5) on the flapper valve 10, an extension passageway (18 in FIG. 2B) defined through the extension (16 in FIG. 5), a flapper housing passageway (20 in FIG. 5), and a pivoting pin 22.

Figure 2A:
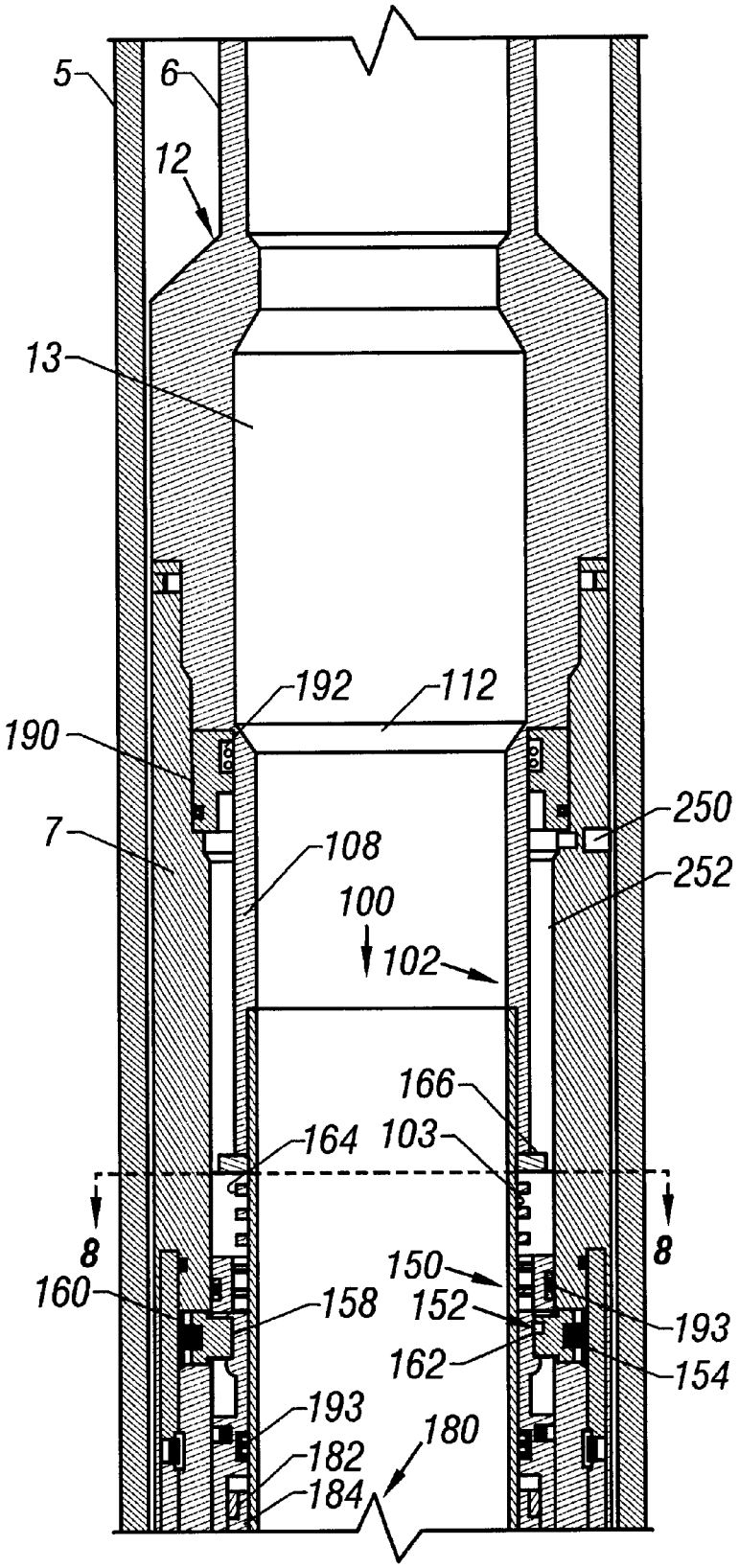
FIG. 2A is a cross-sectional view of an embodiment of a retractable valve with a flapper valve in a closed position and a flow tube assembly in a valve sealing position.
Figure 2B:
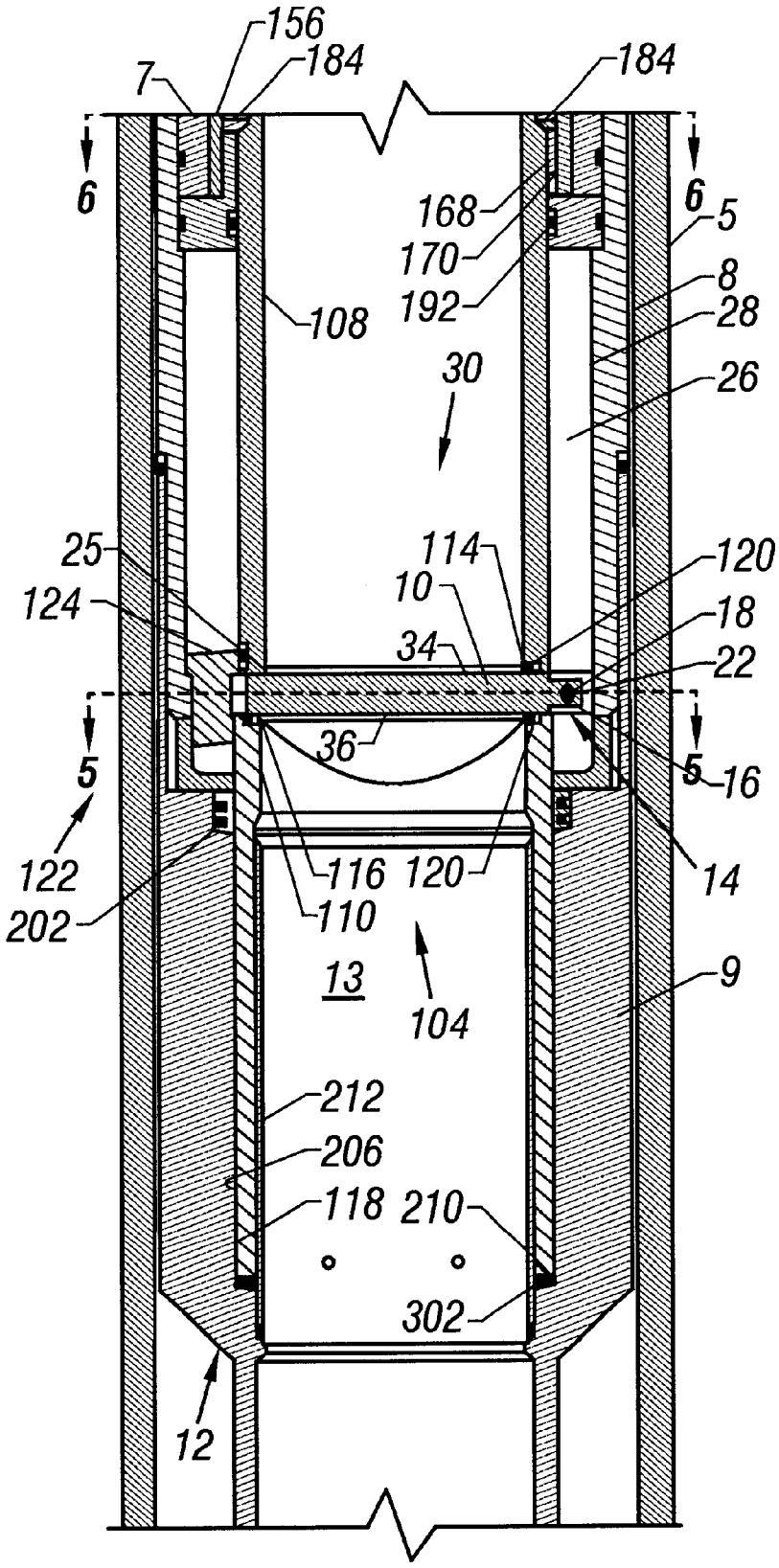
FIG. 2B is a cross-sectional view of an embodiment of a retractable valve with a flapper valve in a closed position and a flow tube assembly in a valve sealing position.

Referring to FIG. 2B, a recess 26 is defined on an inside surface 28 of the flapper housing 8. The recess 26 extends axially along the flapper housing inside surface 28 and houses the extension (16 in FIG. 5) of the flapper valve 10. As best shown in FIG. 5, the flapper housing passageway 20 is defined laterally through the flapper housing 8 on either side of the recess 26. The extension 16 is received within the recess 26 so that the flapper housing passageway 20 is axially aligned with the extension passageway 18. The pivoting pin 22 is positioned within the axially aligned flapper housing passageway 20 and the extension passageway 18. In an embodiment of the invention, the cross-sectional areas of the flapper housing passageway 20 and of the extension passageway 18 may be slightly larger than the cross-sectional diameter of the pivoting pin 22. In an embodiment of the invention, the cross-sectional shape of the flapper housing passageway 20 and of the extension passageway 18 may be elliptical. Flapper valve 10 is able to pivot about pivoting pin 22.

The pivoting mechanism (14 in FIG. 2B) enables the flapper valve 10 to pivot from a closed position (30 in FIG. 2B) to an open position (32 in FIG. 3B). In the closed position (30 in FIG. 2B), the flapper valve 10 prohibits any flow of fluids through the internal bore 13 of the flapper housing 8 and the tool body 12. In the open position (32 in FIG. 3B), the flapper valve 10 permits an unobstructed flow of fluids through the internal bore 13 of the flapper housing 8 and the tool body 12.

Figure 1:
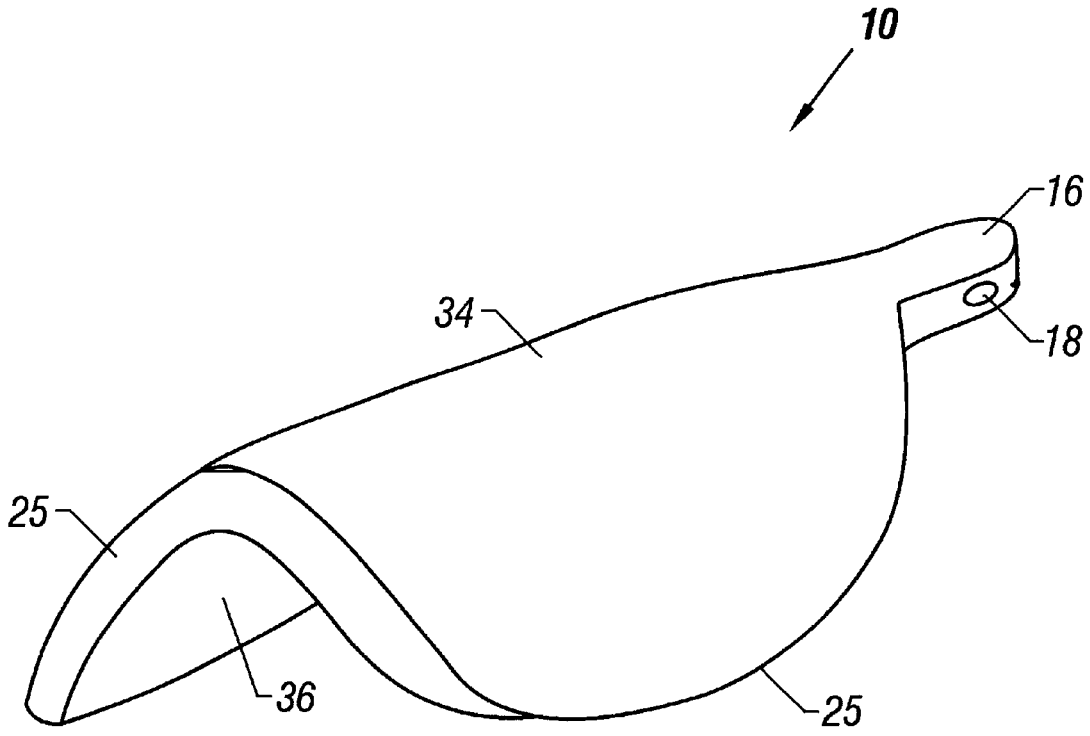
FIG. 1 is an isometric view of a flapper valve in an embodiment of the invention.

Referring to FIG. 1, the flapper valve 10 may be arcuate in shape and comprises a top surface 34, a bottom surface 36, and an outer perimeter 25. The top surface 34 and the bottom surface 36 both have a curvature. In an embodiment of the invention, the flapper valve 10 is formed so that at least portions of the top surface 34 and the bottom surface 36 adjacent the outer perimeter 25 have the same curvature. In another embodiment of the invention, the entire top surface 34 and bottom surface 36 have the same curvature. Having "uniform" or "substantially the same" curvature may also include geometries where the flapper valve 10 has a uniform axial width or a uniform axial length at least along its outer perimeter 25.

In another embodiment of the invention (shown in FIG. 11), a flapper valve 438 is similarly arcuate in shape and has a substantially uniform curvature of its top surface 442 and its bottom surface 444. In contrast to the flapper valve (10 in FIG. 1) of the previous embodiment, the flapper valve 438 comprises a perimeter portion 445 where a top perimeter surface 441 and a bottom perimeter surface 443 of the perimeter portion 445 are substantially perpendicular to a longitudinal axis of the tool body (12 in FIG. 9A). The substantially flat top perimeter surface 441 is adapted to engage a bottom surface 114A of an upper tube member 108A and the substantially perpendicular bottom perimeter surface 443 is adapted to engage a top surface 116A of the lower tube member 110A. The substantially perpendicular top 441 and bottom 443 perimeter surfaces may further comprise a sealing device (not shown) (such as, for example, an elastomer gasket, an elastomer seal, or a similar device) to assist in forming a sealing engagement with the upper 108A and lower 110A tube members. Further, the bottom surface 114A of the upper tube member 108A and the top surface 116A of the lower tube member 110A may be adapted to sealingly engage the top perimeter surface 441 and the bottom perimeter surface 443, respectively, of the flapper valve 438.

In another embodiment of the invention (shown in FIG. 12), a perimeter portion 472 of a flapper valve 471 is arcuate in shape and has a substantially uniform curvature. However, in this embodiment, a top perimeter surface 478 and a bottom perimeter surface 480 of the perimeter portion 472 subtend an angle 482 with respect to a line 484 perpendicular to a longitudinal axis of a tool body (400 in FIG. 9A). The angle 482 may be, for example, 10 degrees, and the angle 482 of the top perimeter surface 478 and the bottom perimeter surface 480 helps support the upper tube member 108A, the flapper valve 471, and the lower tube member 110A when an internal bore 401 of the tool body (400 in FIG. 9A) is pressurized. The upper perimeter surface 478 and the lower perimeter surface 480 may likewise be provided with a sealing device (not shown) as described in the previous embodiment. Further, the upper tube member 108A and the lower tube member 110A may be adapted to sealingly engage the top perimeter surface 478 and the bottom perimeter surface 480 so that the sealing engagement accommodates the angle 482. For example, a bottom surface 114B and a top surface 116B may be angled to match the angle 482 formed on the flapper valve 471.

As shown in FIGS. 2A and 2B, the retractable valve 100 in an embodiment of the invention comprises a flow tube assembly 102 disposed within the tool body 12. The flow tube assembly 102 is operatively connected to the flapper valve (10 in FIG. 2B). The tool body 12 generally comprises an upper sub 6, an upper middle sub 7, the flapper housing 8, and a lower sub 9, each interconnected as shown in FIGS. 2A and 2B. However, the tool body 12 can be formed from one integral member or from any number of subsections and still be within the scope of the invention. For purposes of clarity and brevity, each of the subparts of the tool body 12 (including the upper sub 6, the upper middle sub 7, the flapper housing 8, and the lower sub 9) will generally be referred to generally as the tool body 12.

The flow tube assembly 102 is concentrically and slidably disposed within the internal bore 13 of the tool body 12. Based on its sliding engagement within tool body 12 and its operative connection to the flapper valve (10 in FIG. 2B), the flow tube assembly 102 typically operates in two positions corresponding to the closed (30 in FIG. 2A) and open (32 in FIG. 2B) positions of the flapper valve (10 in FIG. 2B). When the flapper valve (10 in FIG. 2B) is in the closed position (30 in FIG. 2B), the flow tube assembly (102 in FIG. 2B) is in a valve sealing position (104 in FIG. 2B). When the flapper valve (10 in FIG. 3B) is in the open position (32 in FIG. 3B), the flow tube assembly (102 in FIG. 3B) is in a tube engaging position (106 in FIG. 3B).

The flow tube assembly 102 preferably comprises a upper tube member (108 in FIG. 2B) and a lower tube member (110 in FIG. 2B), each of which is concentrically and slidably disposed within the internal bore 13 of the tool body 12. The upper tube member (108 in FIG. 2B) includes a top end (112 in FIG. 2A) and a bottom end (114 in FIG. 2B). The lower tube member (110 in FIG. 2B) also includes a top end (116 in FIG. 2B) and a bottom end (118 in FIG. 2B). The first (108 in FIG. 2B) and second (110 in FIG. 2B) tube members are arranged so that the upper tube member bottom end (114 in FIG. 2B) is proximate the lower tube member top end (116 in FIG. 2B) and so that the upper tube member bottom end (114 in FIG. 3B) is capable of abutting and/or mating with the lower tube member top end (116 in FIG. 3B).

As previously shown in FIG. 2B, when the flapper valve 10 is in the closed position 30, the flow tube assembly 102 is in the valve sealing position 104. In the valve sealing position 104, the flapper valve 10 is sealingly engaged on its top surface 34 and on its bottom surface 36 by the flow tube assembly 102 so that the flapper valve 10 prohibits flow of fluids through the internal bore 13 of the tool body 12. In an embodiment of the invention, the flapper valve top surface 34 is sealingly engaged by the upper tube member 108, preferably by the upper tube member bottom end 114. Further, the flapper valve bottom surface 36 is sealingly engaged by the lower tube member 110, preferably by the lower tube member top end 116. The flapper valve 10 is preferably constructed so that the outer perimeter 25 of the flapper valve 10 is intermediate (e.g., clamped between) the upper tube member 108 and the lower tube member 110 when the flapper valve 10 is in the closed position 30.

In an embodiment of the invention, the upper tube member bottom end 114 and the lower tube member top end 116 each include a sealing element 120 around their respective perimeters. The sealing elements 120 aid the sealing engagement of the upper tube member bottom end 114 to the flapper valve top surface 34 and the sealing engagement of the lower tube member top end 116 to the flapper valve bottom surface 36. In order to sealingly engage the flapper valve top surface 34, the upper tube member bottom end 114 has substantially the same shape (e.g., curvature) as the flapper valve top surface 34. Thus, the upper tube member bottom end 114 also defines an arcuate shape and sealingly engages the flapper valve top surface 34. Similarly, in order to sealingly engage the flapper valve bottom surface 36, the lower tube member top end 116 has substantially the same shape as the flapper valve bottom surface 36. Therefore, the lower tube member top end 116 also defines an arcuate shape and sealingly engages the flapper valve bottom surface 36.

Referring to FIG. 2B, an embodiment of the retractable valve 100 also comprises a biasing mechanism 122. When the flapper valve 10 is in the closed position 30, the biasing mechanism 122 assists in maintaining the sealing engagement between the upper tube member bottom end 114 and the flapper valve top surface 34, and between the lower tube member top end 116 and the flapper valve bottom surface 36. In one embodiment, the biasing mechanism 122 comprises at least one spring 124. One end of each spring 124 is attached to the upper tube member 108 proximate the upper tube member bottom end 114. The other end of each spring 124 is attached to the lower tube member 110 proximate the lower tube member top end 116. The springs 124 bias the upper tube member 108 towards the lower tube member 110 so that the flapper valve 10 is compressed between them. In one embodiment, three springs 124 are disposed around the perimeters of upper tube member 108 and lower tube member 110. The three springs 124 may be disposed, for example, at 90, 180, and 270 degrees around the perimeter of the tube members 108, 110 from the azimuthal position of the pivot pin 22 as shown, for example, in FIG. 5.

Referring to FIG. 3B, when the flapper valve 10 is in the open position 32, the flow tube assembly 102 is in the tube engaging position 106. In the tube engaging position 106, the flapper valve 10 pivots about the pivot pin 22 and is housed within the recess 26 of the tool body 12, leaving the internal bore 13 of the tool body 12 unobstructed. Also in the tube engaging position 106, the upper tube member bottom end 114 is cooperatively engaged to the lower tube member top end 116.

Figure 7:
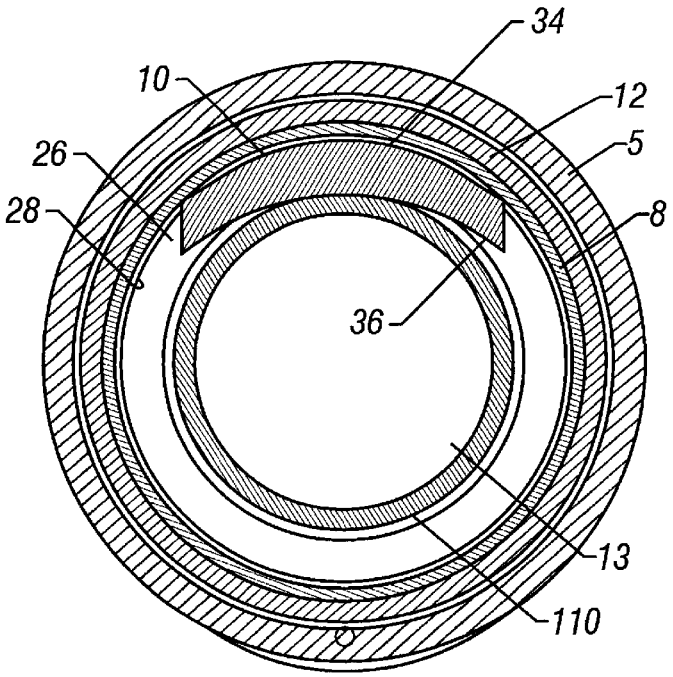
FIG. 7 is a cross-sectional view taken along line VII—VII of FIG. 3B.

Referring to FIG. 7, the arcuate shape of the flapper valve 10 enables the flapper valve 10 to fit within the recess 26 of the tool body 12. The flapper valve 10 may be further formed so that its axial width (or "thickness") is not larger than the radial width of recess 26 so that the flapper valve 10 can be fully housed within the recess 26. When housed in the recess 26, the flapper valve bottom surface 36 is adjacent the flow tube assembly (102 in FIG. 2A) (specifically, the lower tube member (110 in FIGS. 3B and 7)) and the flapper valve top surface 34 is adjacent the tool body 12 (specifically, the flapper housing 8).

The upper tube member bottom end (114 in FIG. 2B) has substantially the same arcuate shape as the flapper valve top surface (34 in FIG. 2B), and the lower tube member top end (116 in FIG. 2B) has substantially the same arcuate shape as the flapper valve bottom surface (36 in FIG. 2B). Moreover, the curvatures of the flapper valve top surface (34 in FIG. 2B) and the flapper valve bottom surface (36 in FIG. 2B) are typically selected to be substantially the same (e.g., the axial length or width of the flapper valve (10 in FIG. 2B) is substantially uniform at least along the outer perimeter (25 in FIG. 1)). This geometric arrangement enables the upper tube member bottom end (114 in FIG. 2B) to cooperatively engage the lower tube member top end (116 in FIG. 2B) around their entire perimeters when the flapper valve (10 in FIG. 2B) is in the open position (32 in FIG. 3B) and housed within the recess (26 in FIG. 3B). Sealing elements (120 in FIG. 3B) that may be arranged around the perimeters of both the upper tube member bottom end (114 in FIG. 3B) and the lower tube member top end (116 in FIG. 3B) help form a sealing engagement between the upper (108 in FIG. 3B) and lower (110 in FIG. 3B) tube members.

In an embodiment of the invention, the retractable valve 100 also comprises an actuating mechanism (150 in FIG. 2A) that causes, after receiving an appropriate stimulus, the flapper valve (10 in FIG. 2B) to pivot from the closed position (30 in FIG. 2B) to the open position (32 in FIG. 3B) and the flow tube assembly (102 in FIG. 2B) to slide from the valve sealing position (104 in FIG. 2B) to the tube engaging position (106 in FIG. 3B). An appropriate stimulus may include, for example, a pressurization of fluid in the internal bore (13 in FIG. 2A) (e.g., a pressure pulse or "cycle" may be generated by turning a surface pump on and off or by varying a surface pump rate) of the retractable valve 100. In an embodiment of the invention, the actuating mechanism (150 in FIG. 2B) causes the flapper valve (10 in FIG. 2B) to move from the valve sealing position (104 in FIG. 2B) to the tube engaging position (106 in FIG. 3B) after the last of a pre-determined number of pressure cycles has been experienced by the retractable valve 100. The actual operation of the retractable valve 100, including the movement of the flapper valve (10 in FIG. 2B) from the closed (30 in FIG. 2B), valve sealing position (104 in FIG. 2B) to the open (32 in FIG. 3B), tube engaging position (106 in FIG. 3B) will be described in detail below.

Referring to FIG. 2A, in an embodiment of the invention, the actuating mechanism 150 comprises an indexing system 152 responsive to a predetermined number of pressure cycles in, for example, the internal bore 13 of the retractable valve 100. Indexing systems that can be used with an embodiment of the invention are known in the art and include, for example, j-slot mechanisms and ratchet mechanisms. The indexing mechanism 152 may be disposed, as shown in FIG. 2A, intermediate the tool body 12 and the flow tube assembly 102. The indexing system 152 generally comprises at least one indexer leg 158 and a sliding indexer sleeve 156. In an alternative embodiment (not shown), the indexer legs 158 may extend directly from the tool body 12. In another embodiment, as shown in FIG. 2A, the indexer legs 158 may extend from a stationary indexer sleeve 154 through the tool body 12. The stationary indexer sleeve 154 is cooperatively attached to the tool body 12 and generally surrounds the flow tube assembly 102. The sliding indexer sleeve 156 is slidably disposed intermediate the tool body 12 and the flow tube assembly 102. Each indexer leg 158 is typically biased inwardly by a leg spring 160 into a series of indexer slot sets 162 defined on the sliding indexer sleeve 156. As best shown in FIG. 4, the number of indexer slot sets 162 corresponds to a selected number of pressure cycles that may be performed before the actuating mechanism (150 in FIG. 2A) causes the flapper valve (10 in FIG. 2A) to pivot from the closed position (30 in FIG. 2B) to the open position (32 in FIG. 3B) and the flow tube assembly (102 in FIG. 2A) to slide from the valve sealing position (104 in FIG. 2B) to the tube engaging position (106 FIG. 3B). Referring again to FIG. 2A, an indexer spring 164 is disposed between a tab 166 on the flow tube assembly exterior surface 103 and the sliding indexer sleeve 156. The indexer spring 164 functions to bias the sliding indexer sleeve 156 to its appropriate position, as will be discussed in detail below.

Additionally (referring to FIGS. 2A and 6), an embodiment of the invention further comprises a securing mechanism 180 that further aids in maintaining the flapper valve (10 in FIG. 2B) in the closed position (30 in FIG. 2B) and the flow tube assembly in the valve sealing position (104 in FIG. 2B) until the last of the pre-determined number of pressure cycles has been completed. The securing mechanism 180 typically comprises an annular member 182 with a plurality of dogs 184. The annular member 182 is securely disposed between the flow tube assembly 102 and the sliding indexer sleeve 156 when the flapper valve (10 in FIG. 2B) is in the closed position (30 in FIG. 2B), and between the flow tube assembly 102 and tool body 12 when the flapper valve (10 in FIG. 3B) is in the open position (32 in FIG. 3B). The plurality of dogs 184 are disposed within a plurality of dog holes 186 in the annular member 182, and the plurality of dogs 184 extend into slots 188 formed on the exterior surface 103 of the flow tube assembly 102.

Referring to FIG. 3B, in an embodiment of the invention, a guide sleeve 212 is disposed concentrically between the tool body 12 and the lower tube member 110 so that the lower tube member 110 is intermediate the tool body 12 and the guide sleeve 212 within an annular space 300. The guide sleeve 212 is typically attached to the tool body 12 and acts to guide the lower tube member 110 during the sliding motion thereof. Further, a face seal 302 is disposed within the annular space 300 on a lip 210 defined on the tool body 12. When the flapper valve 10 is in the closed position (30 in FIG. 2B) and the flow tube assembly (102 in FIG. 2B) is in the valve sealing position (104 in FIG. 213), the lower tube member bottom end (118 in FIG. 2B) typically abuts and sealingly engages the face seal 302. The face seal 302 prevents pressure downhole of the flapper valve (10 in FIG. 2B) from causing fluid in the internal bore (13 in FIG. 2B) to seep into any annular spaces behind, for example, the lower tube member (110 in FIG. 2B) and into, for example, the recess (26 in FIG. 2B).

Referring to FIGS. 2B and 3B, several tube seals 192 are located throughout the flow tube assembly 102 and the tool body 12 in order to sealingly engage the flow tube assembly 102 and to support the sliding movement of the flow tube assembly 102 in relation to the tool body 12. For example, a tube seal (192 in FIG. 2A), disposed on a shoulder (190 in FIG. 2A) defined on the tool body (12 in FIG. 2A), sealably engages the upper tube member (108 in FIG. 2A). Another tube seal (192 in FIG. 3B), disposed on the annular member (182 in FIG. 3B), also sealably engages the upper tube member (108 in FIG. 3B).

Several indexer seals (193 in FIGS. 2A and 3A) are also included on the sliding indexer sleeve (156 in FIG. 2A) in order to sealingly engage the flow tube assembly (102 in FIG. 2A) and to support sliding movement of the sliding indexer sleeve (156 in FIG. 2A) in relation to the tool body (12 in FIG. 2A) and to the flow tube assembly (102 in FIG. 2A). For example, an indexer seal (193 in FIG. 3A), disposed on the surface of sliding indexer sleeve (156 in FIG. 3A) proximate the flow tube assembly (102 in FIG. 3A) sealingly engages the upper tube member (108 in FIG. 3A). Another indexer seal (193 in FIG. 3A), disposed on the surface of sliding indexer sleeve (156 in FIG. 3A) proximate the tool body (12 in FIG. 3A), sealingly engages the upper middle sub (7 in FIG. 3A).

Operation of an Embodiment of the Downhole Valve

The following description details an example of the operation of an embodiment of the downhole or retractable valve 100. The operation described below occurs when the retractable valve 100 is placed in a downhole environment to test, for example, the sealing integrity of production tubing, well liners, etc. The description is not intended to limit the scope of the invention because the retractable valve 100 would operate equally well when testing, for example, an above ground pipeline. The retractable valve 100 also operates equally well in both vertical, slanted, or horizontal arrangements and, therefore, is useful in both vertical and directional wells.

Referring to the embodiment shown in FIGS. 1–8, when the retractable valve 100 is positioned in a tubing string or in drillpipe, the flapper valve 10 is usually in the closed position 30, and the flow tube assembly 102 is therefore in the valve sealing position 104. The flow tube assembly 102 is maintained in its position by several features including the indexing system 152 and the securing mechanism 180. In addition, the lower tube member bottom end 118 is in contact with the face seal 302.

The flapper valve 10 is sealingly engaged on its top surface 34 by the upper tube member bottom end 114 and on its bottom surface 36 by the lower tube member top end 116, and the biasing mechanism 122 compresses the flapper valve 10 between them. Since the flapper valve 10 completely obstructs the internal bore 13 of the tool body 12, the flapper valve 10 prohibits any flow of fluids therethrough. Moreover, since the flapper valve 10 is sealingly engaged on both its top surface 34 and its bottom surface 36 and is prevented from pivoting in any direction by its contact with the upper 108 and lower 110 tube members, the flapper valve 10 may withstand pressure on both its top side 34 and its bottom side 36 without pivoting from its closed position 30.

Further, because the cross-sectional areas (which may be, for example, elliptical) of the extension passageway 18 and the flapper housing passageway 20 are slightly larger than the cross-sectional area of the pivoting pin 22, the flapper valve 10 may experience some small axial movement without affecting the sealing engagement between the flapper valve 10 and the upper 108 and lower 110 tube members. The ability of the flapper valve 10 to compensate for the small axial movement helps the flapper valve 10 compensate for pressure changes both uphole and downhole. The securing mechanism 180 provides support for absorbing any load generated by pressurization of the tool body 12, particularly if a higher pressure is present on the top surface 34 (e.g., the uphole side) of the flapper valve 10.

Once the retractable valve 100 is properly positioned in the tubing string or drillpipe, an operator may conduct pressure testing of downhole equipment. For purposes of discussion, the sequence of events produced by one pressure cycle will be explained. However, the indexing system 152 may operate a plurality of times after a plurality of pressure cycles are experienced before actuating the flapper valve 10 to the open position 32 and moving the flow tube assembly 102 to the tube engaging position 106. The sequence of events produced by one pressure cycle is typically repeated until a selected number of pressure cycles (e.g., five pressure cycles in the embodiment shown in FIGS. 1–8) is achieved. The events that occur after achieving the selected number of pressure cycles will also be described below.

Referring to FIG. 2B, the internal bore 13 of the tool body 12 is pressurized (e.g., by a surface pump such as a surface mud pump or a cement pump) in a first pressure cycle. Because the flapper valve 10 is in the closed position 30, the flapper valve 10 will prohibit any flow of pressurized fluids through the internal bore 13. The pressurized fluids may, however, exit the internal bore 13 through an indexer port 168 that is formed through the flow tube assembly 102 (and through the annular member 182) and that provides fluid communication between the internal bore 13 and an indexer chamber 170. The indexer chamber 170 is at least partially defined in one embodiment by the sliding indexer sleeve 156 and by the annular member 182 and the sliding indexer sleeve 156.

As the pressure is increased in the internal bore 13, the pressure also increases in the indexer chamber 170 due to the fluid communication provided by indexer port 168. Before any indexing motion is initiated, the sliding indexer sleeve 156 is held in place by the cooperative engagement of the indexer legs 158 and the indexer slot sets 162. As best shown in FIG. 4, each slot set 162 includes slots 172A–172E and slots 174A–174E. Prior to the commencement of each pressure cycle, each indexer leg 158 is disposed within, for example, slot 172A of the corresponding slot set 162. The sliding indexer sleeve 156 remains stationary until the pressure in the internal bore 13 (and indexer chamber 170) is increased to a level that generates sufficient pressure so that the sliding indexer sleeve 156 slides upward (e.g., uphole) and compresses the indexer spring 164. The upward movement of the sliding indexer sleeve 156 compresses the indexer spring 164 and also causes each indexer leg 158 to move from the slot 172A to slot 174A of the relevant slot set 162. The upward movement of the sliding indexer sleeve 156 typically further comprises a rotation of the sliding indexer sleeve 156 with respect to the tool body 12 as each indexer leg 158 advances from slot to slot. The rotation of the sliding indexer sleeve 156 may be either clockwise or counterclockwise with respect to the tool body 12, and the direction of rotation is not intended to limit the invention.

When the first pressure cycle is complete and the pressure is decreased within the internal bore 13 and within the indexer chamber 170, several forces serve to cause the sliding indexer sleeve 156 to slide back towards the indexer chamber 170 and rotates, thereby also causing each indexer leg 158 to move from the slot 174A to slot 172B of the slot set 162. For example, in one embodiment the tool body 12 may include an outlet port 250 that provides fluid communication between the annulus defined between the exterior of the tool body 12 and the well casing 5 and a return chamber 252. Return chamber 252 is defined between the tool body 12 and the flow tube assembly 102 and from shoulder 190 to the sliding indexer sleeve 156. The pressure within the return chamber 252 acts on sliding indexer sleeve 156 and opposes the pressure within the indexer chamber 170. Once the pressure is decreased in the internal bore 13 and in indexer chamber 170, the pressure in the return chamber 252 will typically be greater than that in the indexer chamber 170 and will cause the sliding indexer sleeve 156 to slide back towards indexer chamber 170 and rotate. The indexer spring 164 may also assist in biasing the sliding indexer sleeve 156 back toward its original position, particularly in cases when the pressure at the indexer spring 164 side of the sliding indexer sleeve 156 is the same or less than the pressure in the indexer chamber 170.

Figure 8:
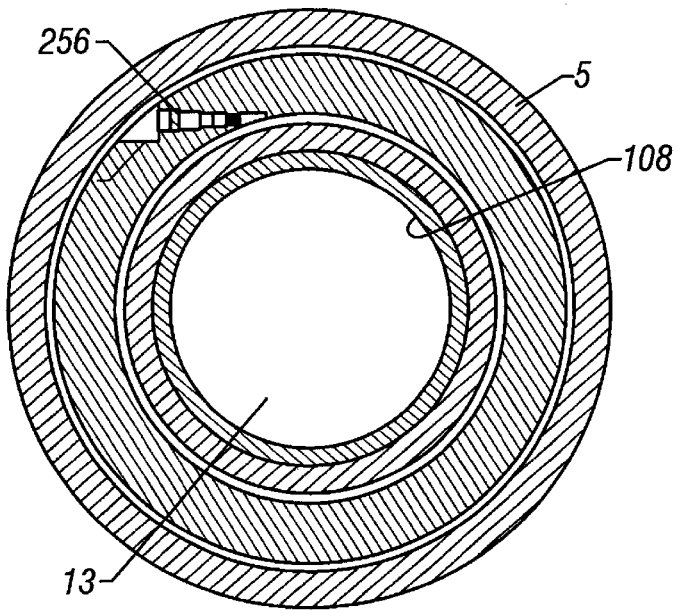
FIG. 8 is a cross-sectional view taken along line VIII—VIII of FIG. 2A.

In another embodiment, as shown in FIG. 8, a nitrogen charge 256 may be disposed within the return chamber 252. At a selected time (e.g., when the pressure is decreased in the internal bore 13 and the sliding indexer sleeve 156 is moving back toward its original position), pressure from the nitrogen charge 256 provides additional force for moving the sliding indexer sleeve 156 back toward its original position (e.g., downhole). In this embodiment, the return chamber 252 is preferably sealed so that the outlet port 250 is typically eliminated or plugged.

The sequence of the subsequent pressure cycles is substantially the same as those previously described as the indexer legs 158 move through slots 172B–172E and 174B–174E, until the last of the predetermined number of pressure cycles. The indexing system 152 illustrated in the Figures is designed to allow five pressure cycles, corresponding to the five indexer slot sets 162, before the flapper valve 10 and the flow tube assembly 102 are actuated and moved into an open position (32 in FIG. 3B). However, a designer may select any number of pressure cycles by appropriately configuring the actuating mechanism 150 and the indexing system 152 to correspond to the chosen number of cycles.

During the last (e.g., the fifth) pressure cycle, the indexer legs 158 are moved from slot 172E to slot 174E. After the sliding indexer sleeve 156 has compressed the indexer spring 164 as a result of increased pressure within internal bore 13 and indexer chamber 170, the pressure is once again decreased within internal bore 13 and indexer chamber 170. As a result, each indexer leg 158 moves to the last slot 175. At this point, the retractable valve 100 is not configured to withstand any more pressure cycles without allowing the flapper valve 10 to pivot from its closed position 30 to its open position 32.

When the operator is prepared to pivot the flapper valve 10 from its closed position 30 to its open position 32, the operator pressurizes the tool body 12 another time (e.g., a sixth time). The increased pressure in the internal bore 13 and the indexer chamber 170 causes the sliding indexer sleeve 156 to slide toward and compress indexer spring 164. Concurrently (because there are no more slot sets 162 for the indexer legs 158 to engage), each indexer leg 158 is guided into an indexer outlet groove 176 that enables each of the indexer legs 158 to completely disengage from the indexing system 152. The disengagement of the indexing system 152 and the continued pressurization of the indexer chamber 170 enables the sliding indexer sleeve 156 to continue its sliding movement and further compress indexer spring 164. At a certain point during its slide, the sliding indexer sleeve 156 contacts tab 166, which is disposed on the exterior surface 103 of the flow tube assembly 102. At another selected point during its slide, the sliding indexer sleeve 156 slides out of abutment with the securing mechanism 180. As a result, and as illustrated in FIG. 3B, the plurality of dogs 184 are no longer secured within their respective slots 188 on the exterior surface 103 of the flow tube assembly 102. Provided that the pressure in the indexer chamber 170 is high enough, the sliding indexer sleeve 156 continues its upward sliding motion (driven by the pressure) and imparts an upward force on the tab 166. The upward force applied to the tab 166 forces the flow tube assembly 102 upwards, which force completely disengages the dogs 184 from within the respective slots 188. The dogs 184 subsequently move outward through the dog holes 186 in the annular chamber 182 and produce a disengagement of the securing mechanism 180. The disengagement of the securing mechanism 180 enables the flow tube assembly 102 to be carried upward as a result of the upward force provided by the pressure acting on the sliding indexer sleeve 156 and to freely slide within the tool body 12. The sliding indexer sleeve 156 and the flow tube assembly 102 continue their upward slide until the tab 166 of the upper tube member 108 contacts a shoulder 190 attached to the tool body 12.

Referring to FIG. 3B, the upward movement of the upper tube member 108 causes the lower tube member 110 to also move upwards because the upper 108 and lower 110 tube members are connected by the biasing mechanism 122 and due to the pressure of the internal bore. As a result, the flapper valve 10, which is positioned between the upper tube member 108 and the lower tube member 110, is at first also forced upward by the upward movement of the flow tube assembly 102. The flapper valve 10 then begins to pivot about pivoting pin 22. During the pivoting motion, the flapper valve 10 first becomes disengaged from the flow tube assembly 102 at the side of flapper valve 10 opposite the pivoting pin 22. Further upward movement of the flow tube assembly 102 rotates the flapper valve 10 until it is substantially parallel with the longitudinal axis of the tool body 12 and completely disengages from the flow tube assembly 102 and is positioned in the recess 26 of the tool body 12. At this point, the flapper valve 10 is in its open position 32. The springs 124 of the biasing mechanism 122 may extend somewhat during the upward slide of the flow tube assembly 102 and assist in rotating the flapper valve 10 from the closed position 30 to the open position 32.

Referring to FIG. 3B, when in the closed position 32, the flapper valve 10 permits an unobstructed flow of fluids within the internal bore 13 of the tool body 12. Further, with the flapper valve 10 disengaged from the flow tube assembly 102, the lower tube member 110 continues to slide upward and is pulled into contact with the upper tube member 108 by the biasing mechanism 122 and the pressure in the internal bore. Because the upper tube member bottom end 114 is formed to cooperatively mate with the lower tube member top end 116 (e.g., because the arcuate shapes of the upper surface 34 and the lower surface 36 of the flapper valve 10 are typically substantially the same), the biasing mechanism 122 helps to bring the upper tube member 108 and the lower tube member 110 into a cooperative engagement. The cooperative engagement between upper tube member 108 and lower tube member 110 is important because it provides for an unobstructed flow of fluids within the internal bore 13. In the embodiment including sealing elements 120, the sealing elements provide a cooperative sealing engagement between the upper and lower tube members 108 and 110 thereby preventing leakage of fluid from the internal bore 13.

In an embodiment of the invention, the flow tube assembly 102 further comprises a locking mechanism (200 in FIG. 3B) that locks the flow tube assembly 102 in the tube engaging position 106. The locking mechanism (200 in FIG. 3B) typically comprises at least one ratchet member (202 in FIG. 3B) disposed on the tool body 12 and a locking surface (206 in FIGS. 2B and 3B) defined on the exterior surface 103 of the flow tube assembly 102. Each ratchet member (202 in FIG. 3B) includes ratchet member teeth (204 in FIG. 3B) proximate the flow tube assembly 102. The locking surface (206 in FIG. 3B) includes locking surface teeth (208 in FIG. 3B) that mate with the ratchet member teeth (204 in FIG. 3B).

In the valve sealing position 104 shown in FIG. 2B, when the flapper valve 10 is in the closed position 30, the locking surface (206 in FIG. 2B) is located below the ratchet members (202 in FIG. 2B). During the upward movement of the flow tube assembly 102 from the valve sealing position 104 to the tube engaging position 106, the locking surface (206 in FIG. 2B) slides toward the ratchet member (202 in FIG. 2B). Once the locking surface teeth (208 in FIG. 3B) are in direct contact with the ratchet member teeth (204 in FIG. 3B), the ratchet member teeth (204 in FIG. 3B) and the locking surface teeth (208 in FIG. 3B) are designed to allow the locking surface (206 in FIG. 3B) to move upward in relation to the ratchet members (202 in FIG. 3B) but to prohibit the locking surface (206 in FIG. 3B) (and flow tube assembly 102) to move downward (e.g., downhole). Thus, once the lower tube member 110 stops its upward movement, the cooperative engagement of the ratchet member teeth (204 in FIG. 3B) and the locking surface teeth (208 in FIG. 3B) locks the lower tube member 110 (and the flow tube assembly 102) axially in place.

Additional Embodiments of the Downhole Valve

Figure 9A:
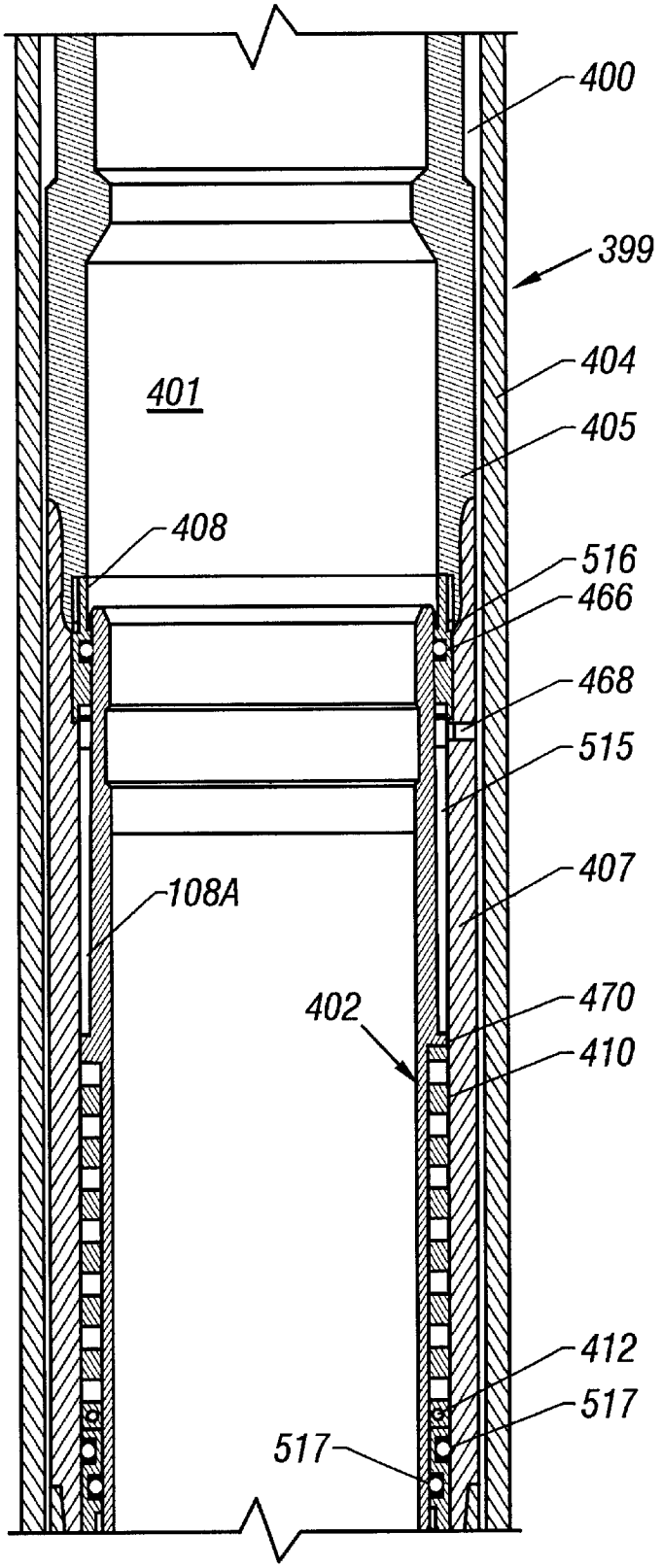
FIG. 9A is a cross-sectional view of an embodiment of the retractable valve with the flapper valve in a closed position and the flow tube assembly in a valve sealing position.

Another embodiment of the invention is shown in FIGS. 9A–9E and 10A–10E. Referring to FIG. 9A, an embodiment of the invention comprises a downhole valve 399 comprising a tool body 400 and a flow tube assembly 402. The tool body 400 further comprises an upper sub 405, an upper middle sub 407, a middle sub (409 in FIG. 9B), a middle sub (411 in FIG. 9C), a lower middle sub (413 in FIG. 9D), a lower sub (415 in FIG. 9E), and a flapper housing (448 in FIG. 9D). For simplicity and clarity, the subs (405, 407, 409, 411, 413, and 415) will be referred to as being part of the tool body 400.

The operation of the downhole valve (399 in FIG. 9A) is similar to the operation of the valve (100 in FIG. 2A) discussed in previous embodiments. However, there are differences that will be discussed in detail below. The downhole valve (399 in FIG. 9A) is generally positioned in a downhole casing string (404 in FIG. 9A) or other tubular string (such as, for example, production tubing). The flow tube assembly (402 in FIG. 9A) is positioned inside the tool body (400 in FIG. 9A) and further comprises an upper tube member (108A in FIG. 9A) and a lower tube member (110A in FIG. 9D). The upper tube member (108A in FIG. 9A) and the lower tube member (110A in FIG. 9D) are adapted to sealingly engage a flapper valve (438 in FIG. 9D) when the flapper valve (438 in FIG. 9D) is in a closed position (446 in FIG. 9D). The sealing engagement has been previously described in the discussion of FIGS. 11 and 12.

The flow tube assembly (402 in FIG. 9A) also comprises an upper spring (410 in FIG. 9A) that is positioned between an upper shoulder (470 in FIG. 9A) formed on the upper tube member (108A in FIG. 9A) and a bearing assembly (412 in FIG. 9A). The upper spring (410 in FIG. 9A) operates cooperatively as a part of an indexing system (435 in FIG. 9B) by providing an axial force that helps hold an indexer leg (414 in FIG. 9B) of the indexing system (435 in FIG. 9B) in an appropriate slot formed on a sliding indexer sleeve (416 in FIG. 9B). The bearing assembly (412 in FIG. 9A) operates cooperatively as a part of the indexing system (435 in FIG. 9B) by permitting the sliding indexer sleeve (416 in FIG. 9B) to rotate relative to the upper spring (410 in FIG. 9A) when the indexing system (435 in FIG. 9B) is operating. The bearing assembly (412 in FIG. 9A) may comprise a roller bearing, a needle bearing, a pair of thrust washers, or any other bearing known in the art.

Figure 9B:
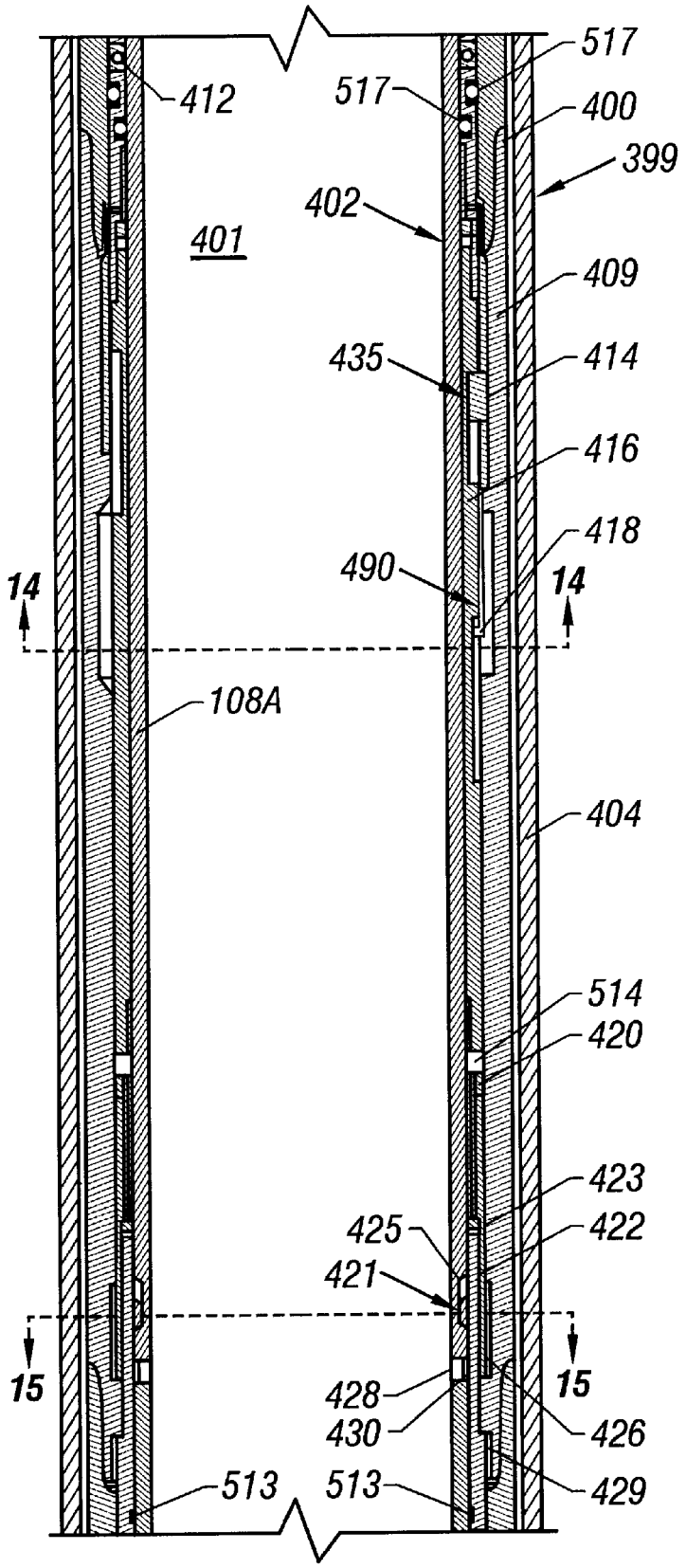
FIG. 9B is a cross-sectional view of an embodiment of the retractable valve with the flapper valve in a closed position and the flow tube assembly in a valve sealing position.
Figure 9C:
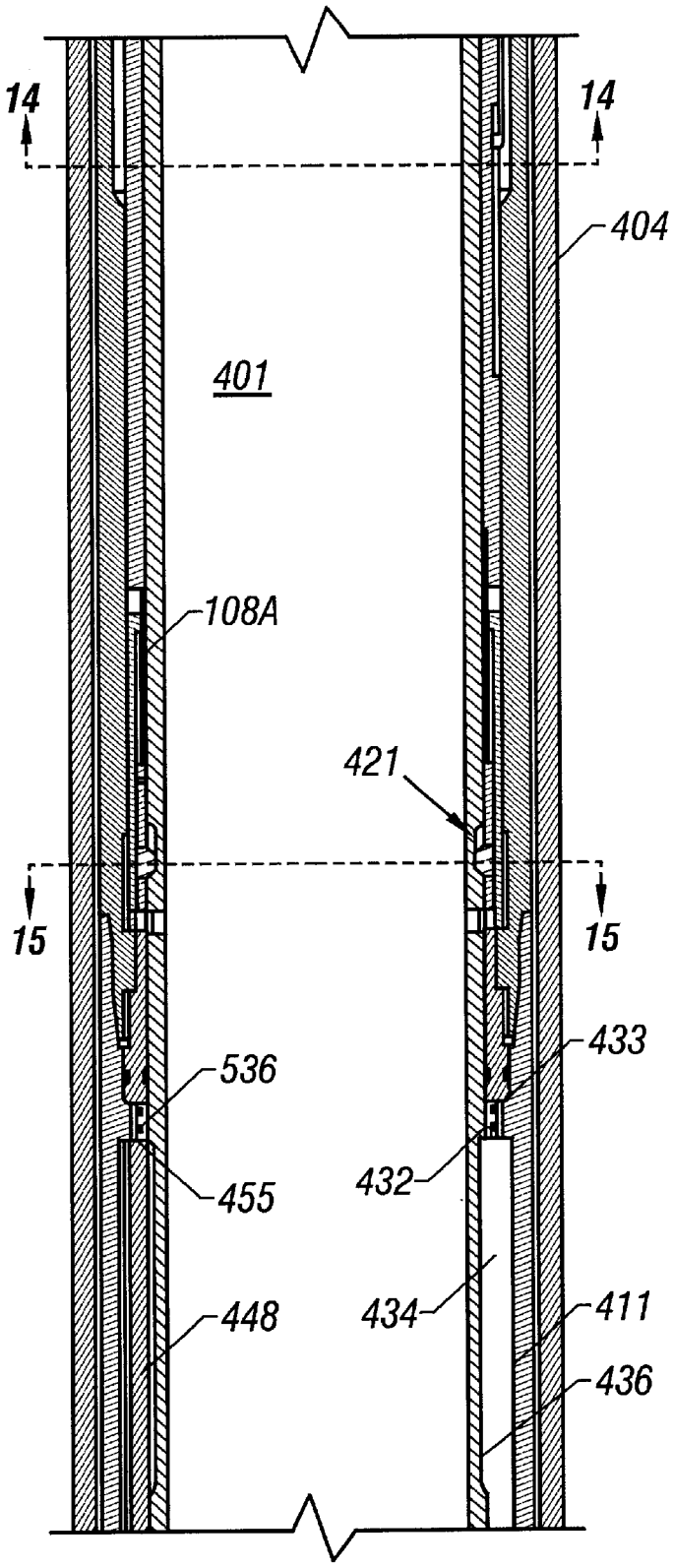
FIG. 9C is a cross-sectional view of an embodiment of the retractable valve with the flapper valve in a closed position and the flow tube assembly in a valve sealing position.

Referring to FIG. 9B, the indexing system 435 is similar to the indexing system (152 in FIG. 2B) of previous embodiments. The indexing system 435 typically comprises one indexing leg 414 and a sliding indexer sleeve 416. As shown in FIG. 9B, the indexer leg 414 is attached to the tool body 400 (specifically to the middle sub 409). The attachment may be a fixed attachment (e.g., via a weld, etc.), a removable attachment (e.g., similar to that shown in the previous embodiments), or any other attachment mechanism known in the art. The sliding indexer sleeve 416 is positioned intermediate the tool body 400 and the flow tube assembly 402. The indexer leg 414 engages the sliding indexer sleeve 416 during the operation of the indexing system 435 enabling the indexer sleeve 416 to slide in an upward direction, thereby compressing the upper spring 410. As disclosed in previous embodiments, the upward movement of the sliding indexer sleeve 416 typically further comprises a rotation of the sliding indexer sleeve 416 with respect to the tool body 400.

Referring again to FIG. 9B, the operation of the indexing system 435 is similar to that of the previous embodiment. To operate the indexing system 435 when the flapper valve (438 in FIG. 9D) is in the closed position (446 in FIG. 9D), the internal bore 401 of the tool body 400 is pressurized by, for example, a surface pump for a selected number of pressure cycles. When the internal bore 401 is pressurized, the high pressure from the internal bore 401 is transmitted through a port 428 in the upper tube member 108A and through port 430 in the sliding indexer sleeve 416 into a lower chamber 514. The high pressure in the lower chamber 514 forces the sliding indexer sleeve 416 upward and rotates the sliding indexer sleeve 416, thereby compressing the upper spring 410 and starting the indexing process. When the pressure in the internal bore 401 is decreased at the end of a pressure cycle, the pressure in the lower chamber 514 is also decreased. External fluid pressure (which may also be referred to as annular fluid pressure, and which at this point is generally higher than the fluid pressure in the internal bore 401) may then enter the tool body 400 through a port (468 in FIG. 9A) formed in the tool body 400. The fluid enters through the port (468 in FIG. 9A) and into an upper chamber (515 in FIG. 9A). The fluid pressure in the upper chamber (515 in FIG. 9A) acts to force the indexer sleeve 416 axially downward and to rotate the sliding indexer sleeve 416 until the indexer leg 414 is seated in an appropriate slot (as will be described in detail below). The upper spring 410 also provides an axially downward (e.g., downhole) force that helps seat the indexer leg 414 in the appropriate slot.

Referring to FIG. 9A, the upper chamber 515 is sealed at an upper end by at least one seal 466. The seal 466 is formed against an outer surface 516 of the upper tube member 108A. The upper chamber 515 is sealed at a lower end by at least one seal 517. Referring to FIG. 9B, the lower chamber 514 is similarly sealed at a lower end by at least one seal 513 and at an upper end by at least one seal 517.

Figure 13:
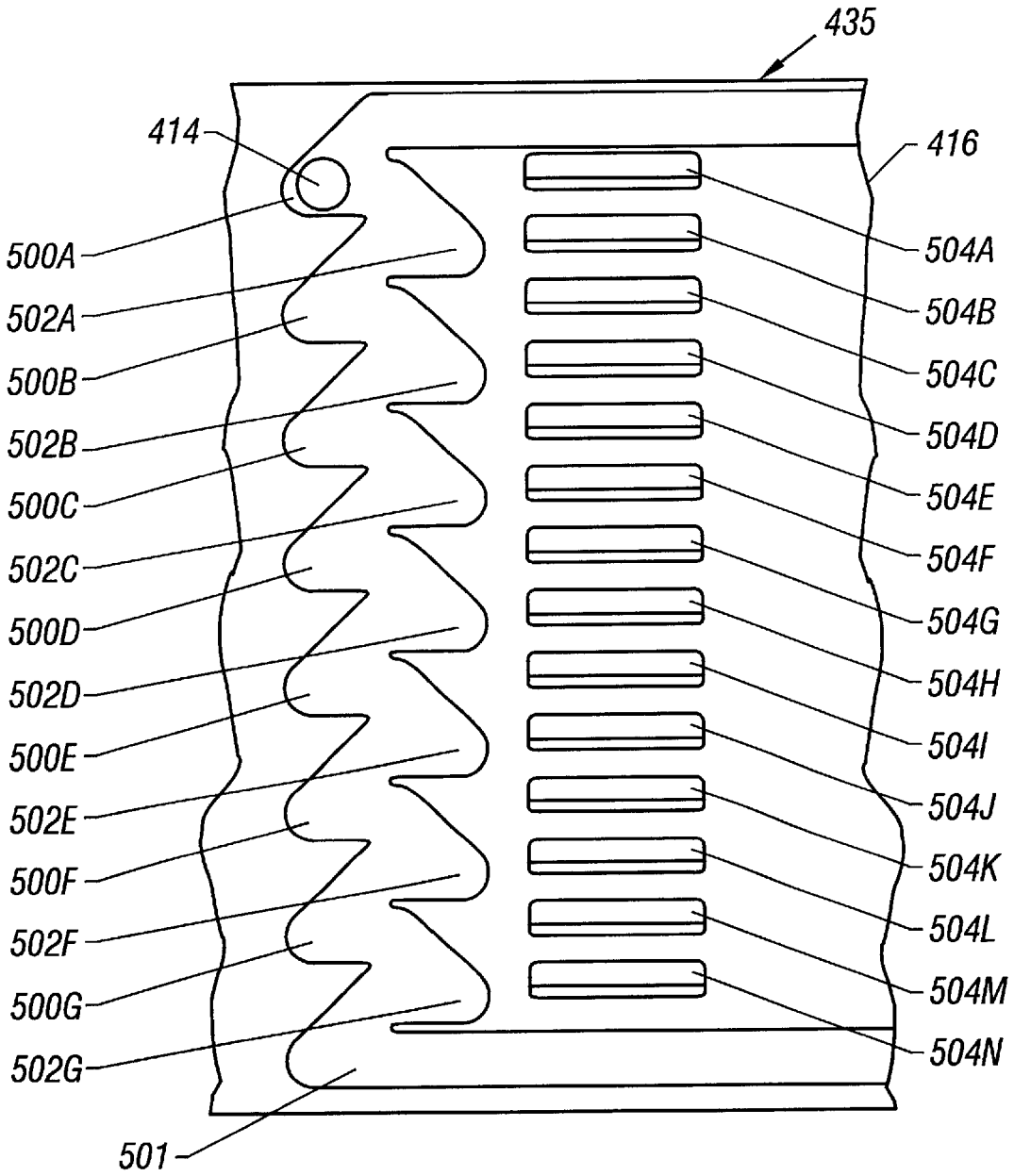
FIG. 13 is a schematic view of the indexer slot sets and ratchet slots of an indexing system of an embodiment of the invention.

As shown in FIG. 13, the sliding indexer sleeve comprises a plurality of indexer slots 500A–500G and 502A–502G. Each pair of slots (e.g., 500A and 502A) correspond to the operation of the indexing system 435 in response to a pressure cycle (as previously defined in the discussion of the other embodiments). For example, FIG. 13 shows seven pairs of slots (500A/502A–500G/502G) that correspond to seven pressure cycles in the operation of the indexing system 435. After the seventh pressure cycle has been completed, the indexer leg 414 enters an indexer outlet groove 501 and slides so that the sliding indexer sleeve 416 is disengaged from the indexer leg 414 (thereby permitting the upper tube member 108A to slidably move in an upward direction and compress upper spring (410 in FIG. 9A)).

Figure 14:
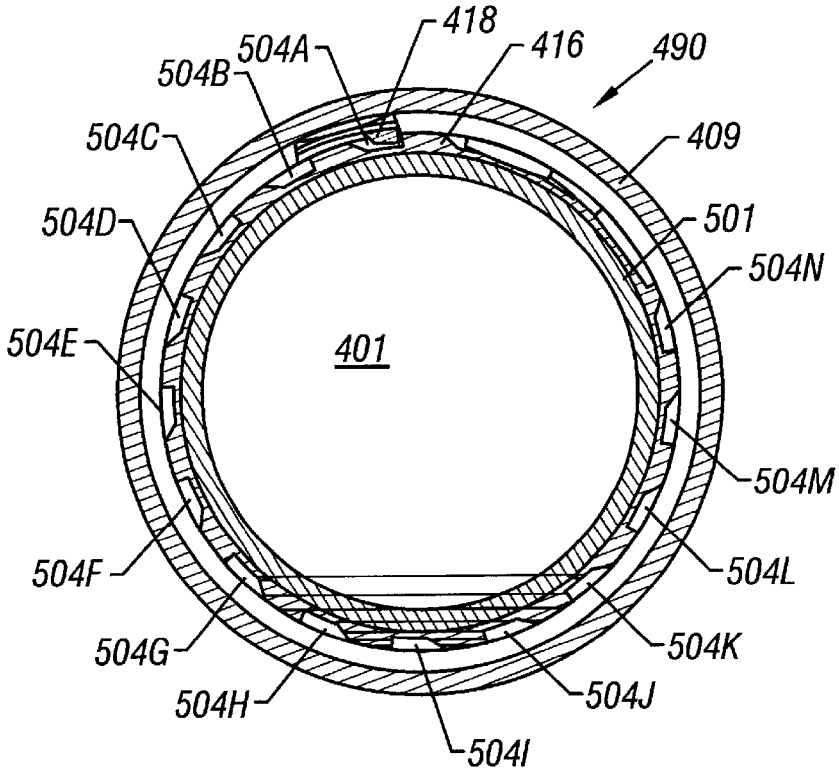
FIG. 14 is a cross-sectional view taken along line XIV—XIV of FIG. 9B.

Another embodiment of the invention also includes a ratcheting collet mechanism (490 in FIG. 14) that comprises a ratcheting collet (418 in FIG. 14) and a plurality of ratchet slots (504A–504N in FIGS. 13 and 14) in the sliding indexer sleeve (416 in FIGS. 13 and 14). In operation, as the sliding indexer sleeve (416 in FIG. 14) rotates relative to the tool body (400 in FIG. 9A) in response to a pressure cycle, the ratcheting collet (418 in FIG. 14) advances from, for example, ratchet slot (504A in FIG. 13) to ratchet slot (504B in FIG. 13). Typically, the number of ratchet slots (504A–504N in FIG. 13) comprises the total number of indexer slots (500A–500G plus 502A–502G in FIG. 13). For example, in FIG. 13, the embodiment shown is designed to disengage the sliding indexer sleeve 416 after seven pressure cycles. As a result, there are a total of fourteen indexer slots (500A–500G plus 502A–502G in FIG. 13) in the sliding indexer sleeve 416. Therefore, as shown in FIGS. 13 and 14, there are a total of fourteen ratchet slots 504A–504N.

The operation of the ratcheting collet mechanism (490 in FIG. 14) is similar to that of the indexing system (435 in FIGS. 9B and 13). For example, when one (e.g., the first) pressure cycle is completed, the indexer leg (414 in FIG. 13) moves from one indexer slot (500A in FIG. 13) past indexer slot (502A in FIG. 13) and into indexer slot (500B in FIG. 13). As the sliding indexer sleeve (416 in FIG. 14) rotates, the ratcheting collet (418 in FIG. 14) correspondingly moves from ratchet slot (504A in FIG. 14) to ratchet slot (504C in FIG. 14). The ratcheting collet (418 in FIG. 14) is adapted to prevent the sliding indexer sleeve (416 in FIG. 14) from rotating in the opposite direction of that desired (e.g., the ratcheting collet mechanism (490 in FIG. 14) prevents the sliding indexer sleeve (416 in FIG. 13) from moving downward so that the indexer leg (414 in FIG. 13) cannot move from, for example, indexer slot (500B in FIG. 13) back to indexer slot (500A in FIG. 13)). The ratchet slots 504A–504N, as shown in FIG. 14, are designed so that the ratchet collet (418 in FIG. 14) cannot move from, for example, ratchet slot (504B in FIG. 14) to ratchet slot (504A in FIG. 14) in a reversed rotation. However, as shown in FIGS. 13 and 14, after the seventh pressure cycle, the ratchet collet (418 in FIG. 14) enters the indexer outlet groove (501 in FIGS. 13 and 14) (along with the indexer leg (414 in FIG. 13)) so that the sliding indexer sleeve (416 in FIGS. 13 and 14) may move freely upward.

Figure 15:
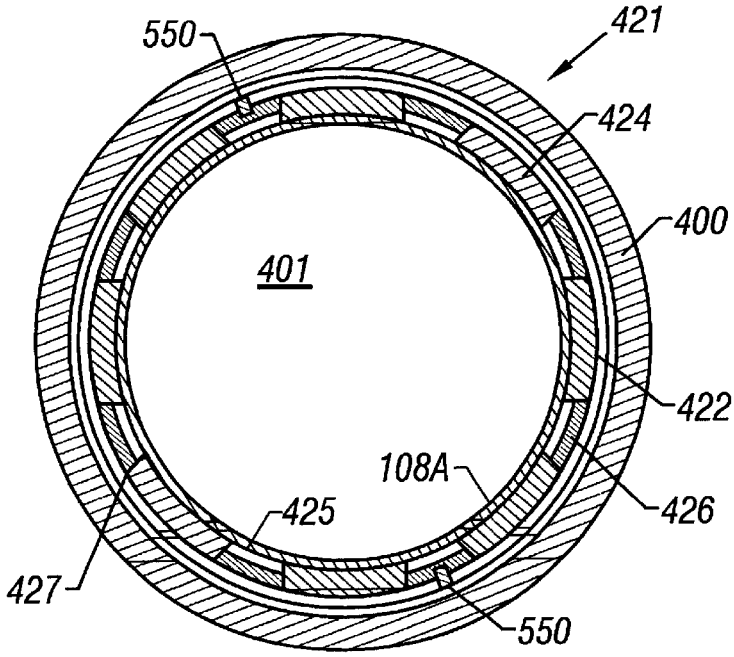
FIG. 15 is a cross-sectional view taken along line XV—XV of FIG. 9C.

Referring to FIG. 9B, and in a manner similar to that of previous embodiments, the invention further comprises a securing mechanism 421 that helps hold the upper tube member 108A and the lower tube member 110A in sealing engagement with the flapper valve 438 until the last of the predetermined number of pressure cycles has been completed. The securing mechanism (421 in FIG. 15) comprises an outer sleeve (426 in FIG. 15) that is slidably disposed intermediate the tool body (400 in FIG. 15) and an inner sleeve (422 in FIG. 15). The inner sleeve (422 in FIG. 15) is positioned intermediate the upper tube member (108A in FIG. 15) and the outer sleeve (426 in FIG. 15) and includes a plurality of slots (427 in FIG. 15). The outer sleeve (426 in FIG. 15) may also be axially fixed in position with, for example, shear pins (550 in FIG. 15). However, any other similar securing mechanism known in the art may be used. A plurality of dogs (424 in FIG. 15) are positioned in the plurality of slots (427 in FIG. 15), and the dogs (424 in FIG. 15) are also cooperatively positioned in slots (425 in FIG. 15) formed in the upper tube member (108A in FIG. 15). The dogs (424 in FIG. 9B) axially secure the upper tube member (108A in FIG. 9B) in place because the dogs (424 in FIG. 9B) operatively connect the upper tube member (108A in FIG. 9B) to the inner sleeve (422 in FIG. 9B) which is, in turn, secured to the tool body (400 in FIG. 9B) at a shoulder contact point (429 in FIG. 9B).

Figure 10A:
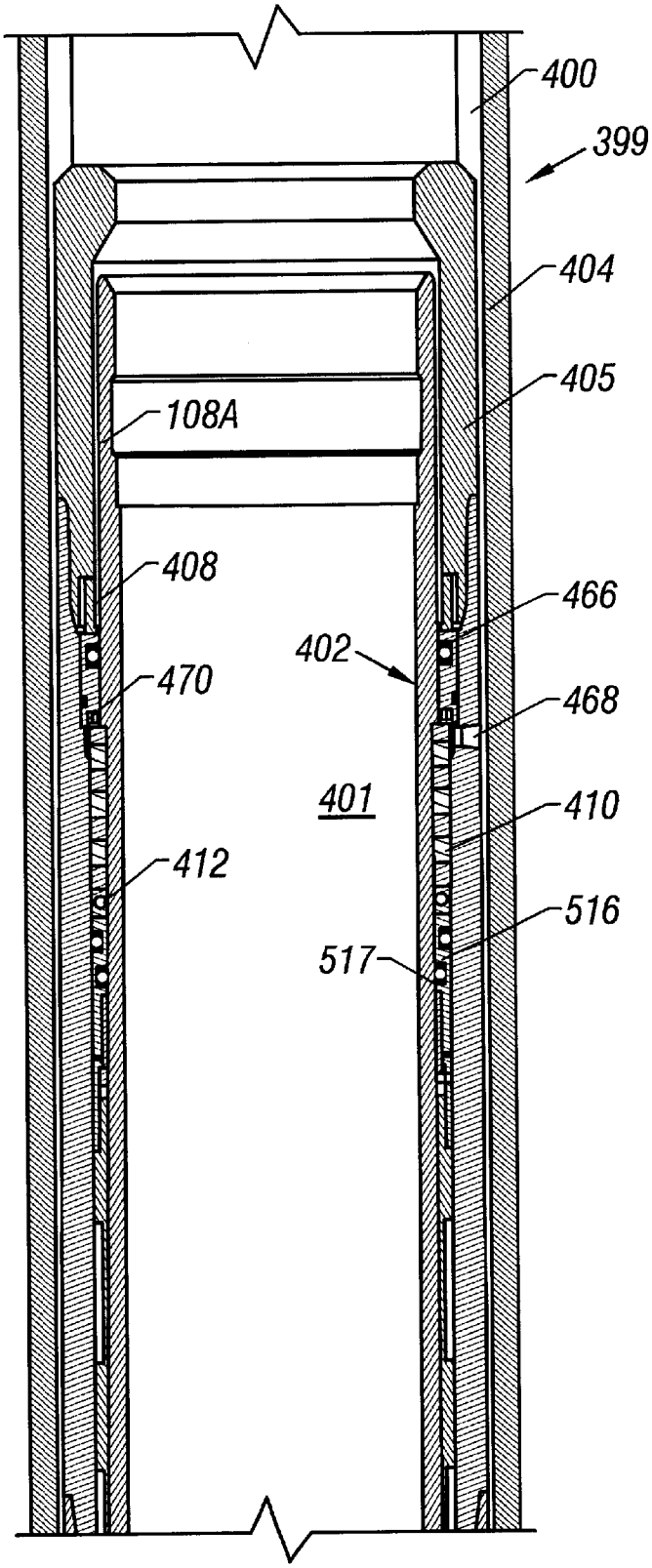
FIG. 10A is a cross-sectional view of an embodiment of a retractable valve with a flapper valve in an open position and a flow tube assembly in a tube engaging position.
Figure 10B:
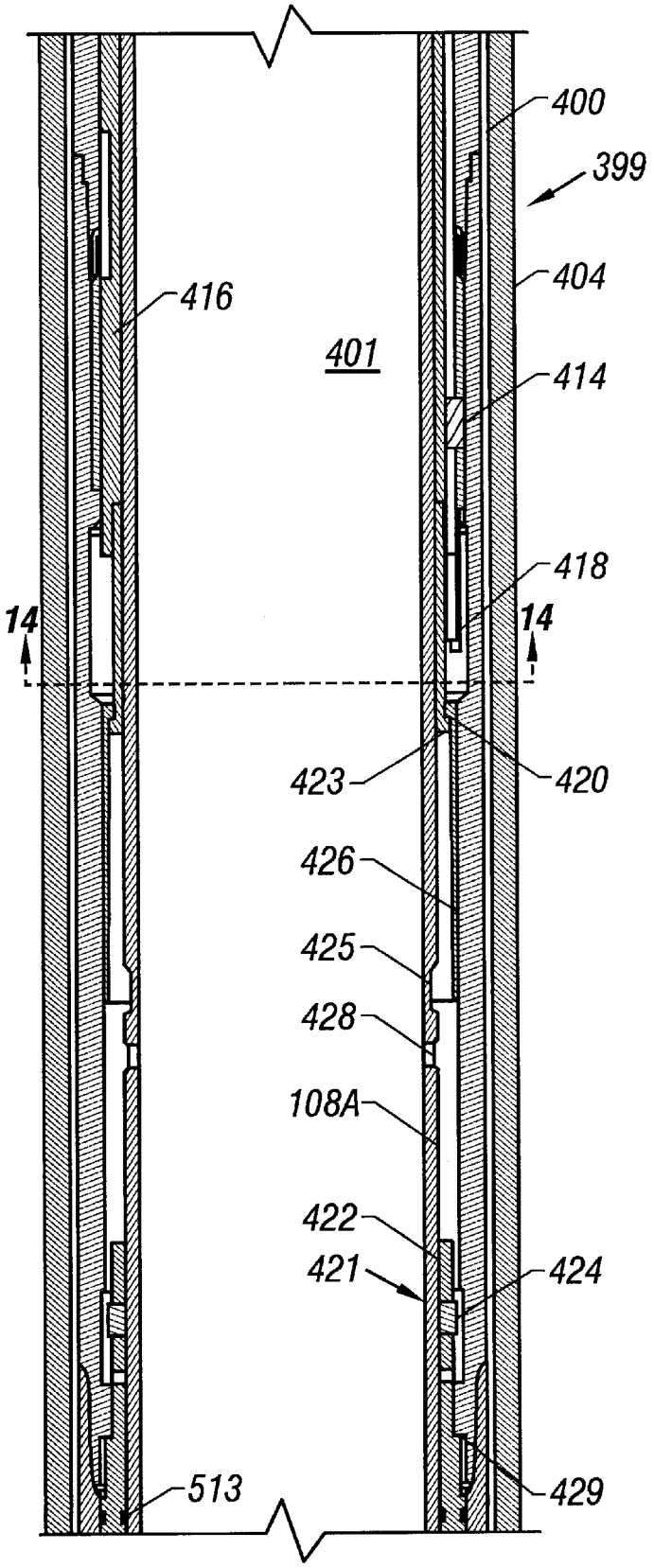
FIG. 10B is a cross-sectional view of an embodiment of a retractable valve with a flapper valve in an open position and a flow tube assembly in a tube engaging position.

Referring to FIG. 10B, the securing mechanism 421 is designed to release the upper tube member 108A after the predetermined number of pressure cycles have been completed. In operation, after the predetermined number of pressure cycles (e.g., after the seventh pressure cycle has been completed), the sliding indexer sleeve 416 has moved up so that a lower shoulder 423 of the sliding indexer sleeve 416 has contacted an upper shoulder 420 of the outer sleeve 426. As the sliding indexer sleeve 416 begins to freely slide upwards, the sliding indexer sleeve 416 (because of the contact between the lower shoulder 423 and the upper shoulder 420) urges the outer sleeve 426 upward so that the plurality of dogs 424 may move radially outward and out of the slots 425 in the upper tube member 108A. The upper tube member 108A is then no longer secured by the securing mechanism 421 and may slide freely upward. The upward movement of the upper tube member 108A is produced by the upward movement of the sliding indexer sleeve 416 (which is produced by the pressure in the internal bore 401).

Figure 9D:
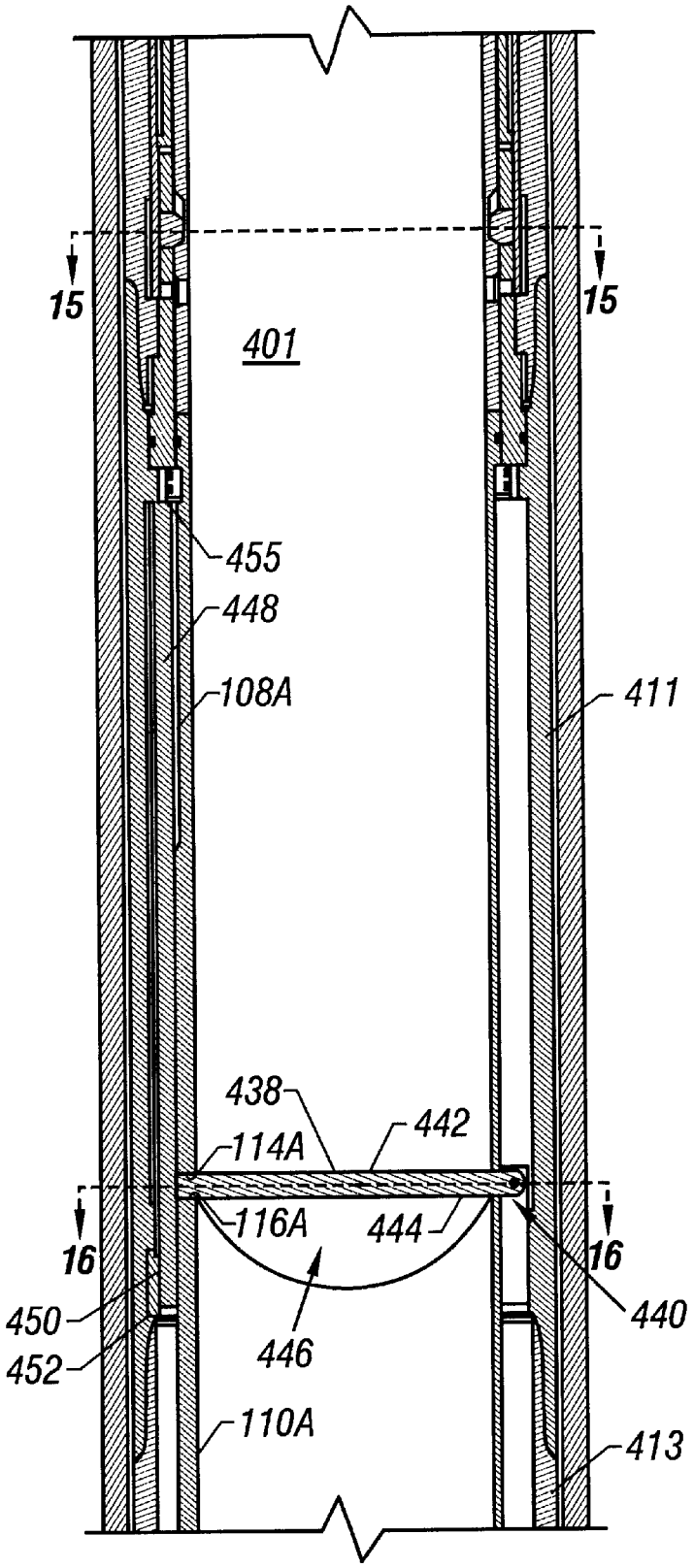
FIG. 9D is a cross-sectional view of an embodiment of the retractable valve with the flapper valve in a closed position and the flow tube assembly in a valve sealing position.
Figure 9E:
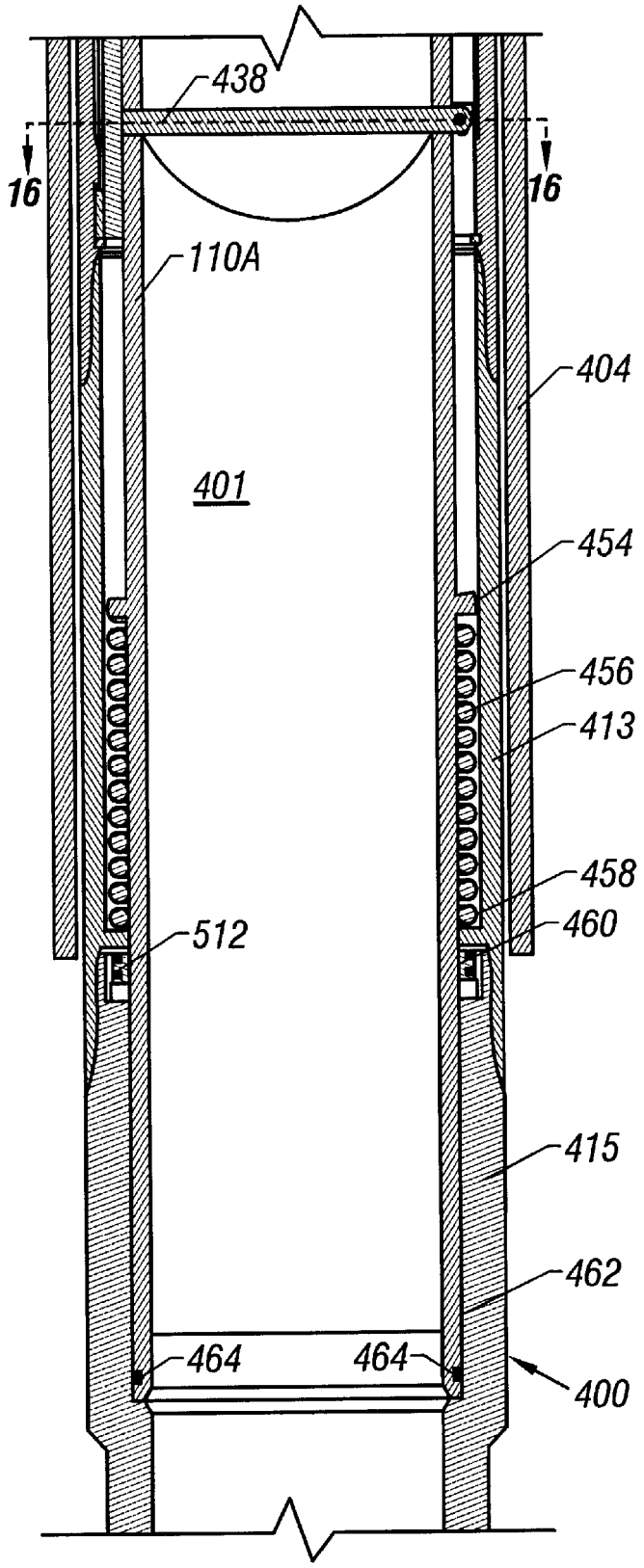
FIG. 9E is a cross-sectional view of an embodiment of the retractable valve with the flapper valve in a closed position and the flow tube assembly in a valve sealing position.
Figure 10D:
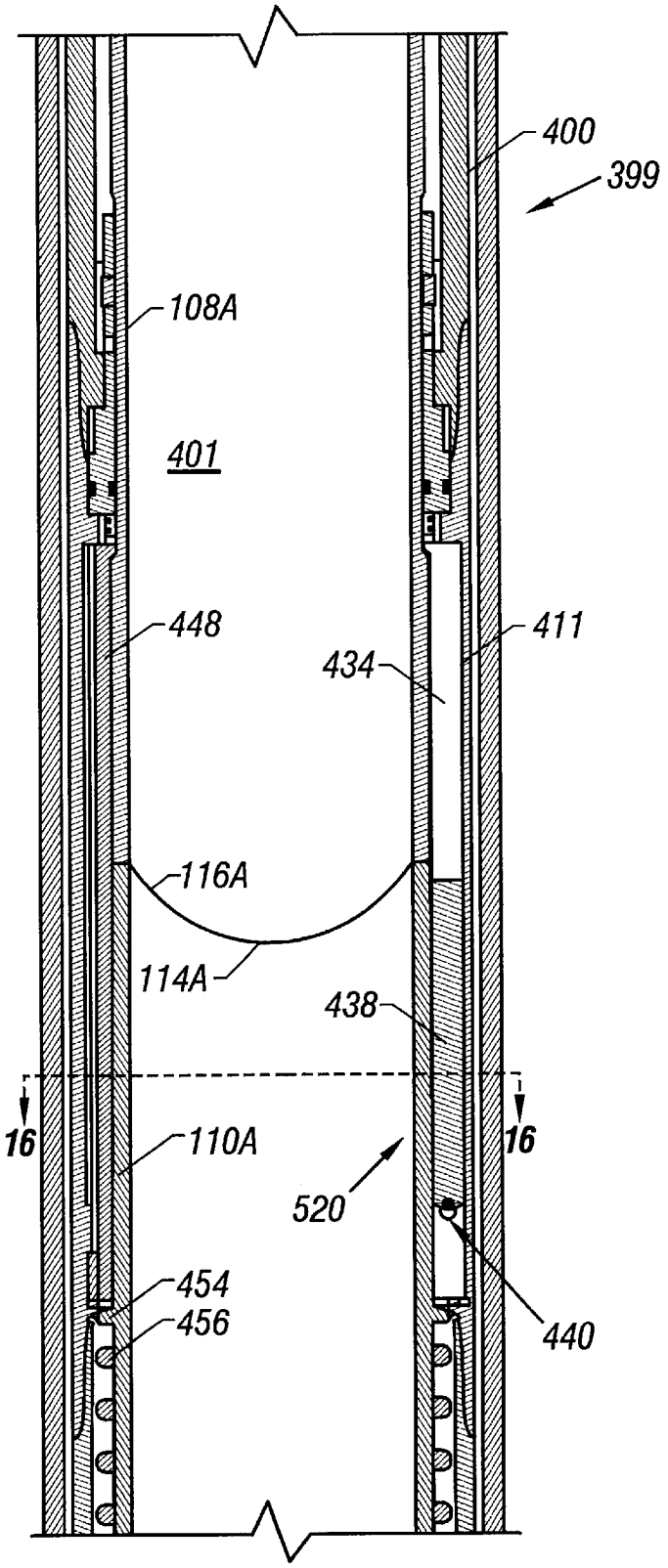
FIG. 10D is a cross-sectional view of an embodiment of a retractable valve with a flapper valve in an open position and a flow tube assembly in a tube engaging position.
Figure 11:
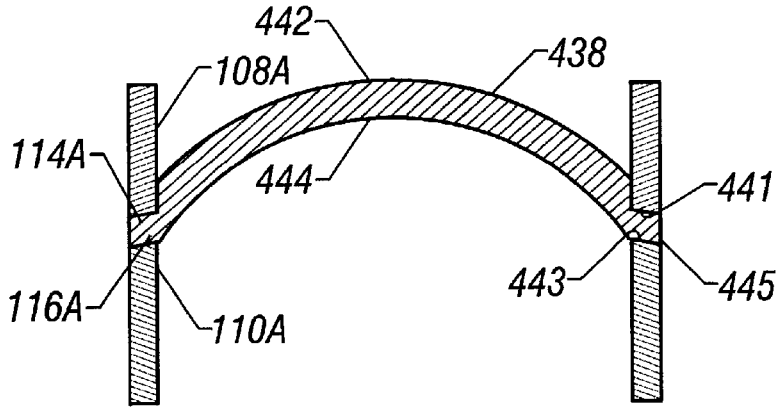
FIG. 11 is a cross-sectional view of a flapper valve of an embodiment of the invention.
Figure 12:
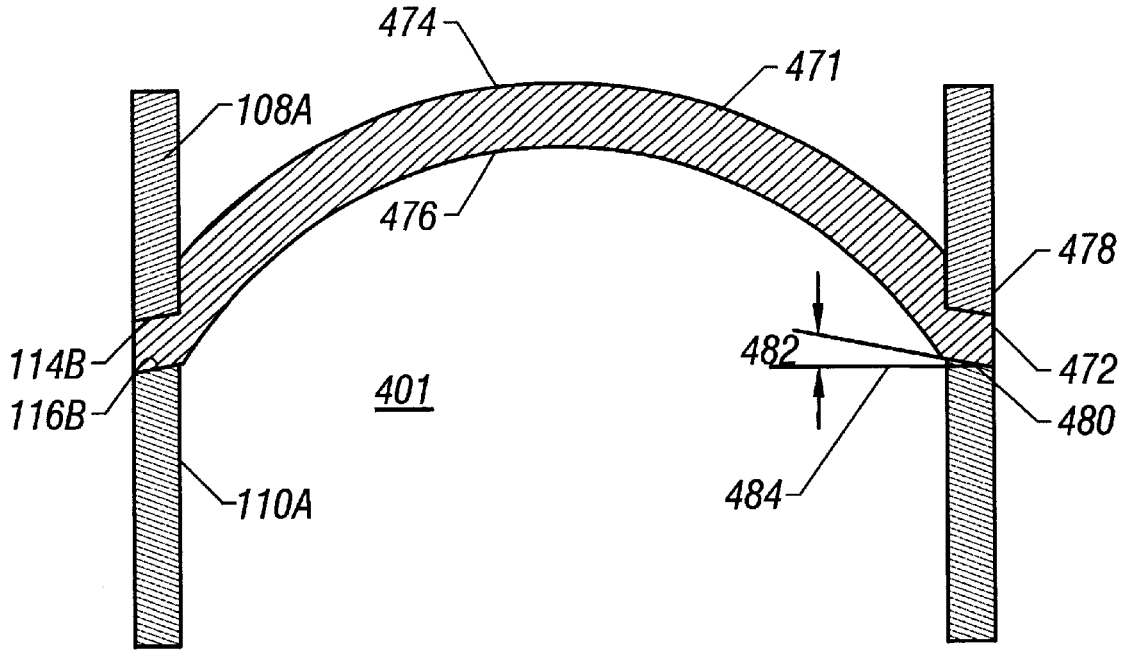
FIG. 12 is a cross-sectional view of a flapper valve of an embodiment of the invention.

Referring to FIG. 9D, the flapper valve 438 of an embodiment of the invention is sealingly engaged in its closed position 446 by a bottom surface 114A of the upper tube member 108A and a top surface 116A of the lower tube member 110A. Referring to FIGS. 11 and 12, the bottom surface 114A and the top surface 116A may be adapted, for example, to sealingly engage the perimeter portion 472 of the flapper valve 471. For example, FIG. 12 shows that the bottom surface 114B and the top surface 116B may be angled to match an angle 482 formed by the top perimeter surface 478 and the bottom perimeter surface 480 of the perimeter portion 472 of the flapper valve 471. As in the previous embodiment, the flapper valve 438, the upper tube member bottom surface 114A, and the lower tube member upper surface 116A are constructed so that [1] the flapper valve 438 is sealingly engaged in its closed position 446 by the upper tube member bottom surface 114A and the lower tube member top surface 116A (see FIG. 9D) and [2] the upper tube member bottom surface 114A is cooperatively engaged to the lower tube member top surface 116A when the flapper valve is in the open position 520 (see FIG. 10D).

Figure 16:
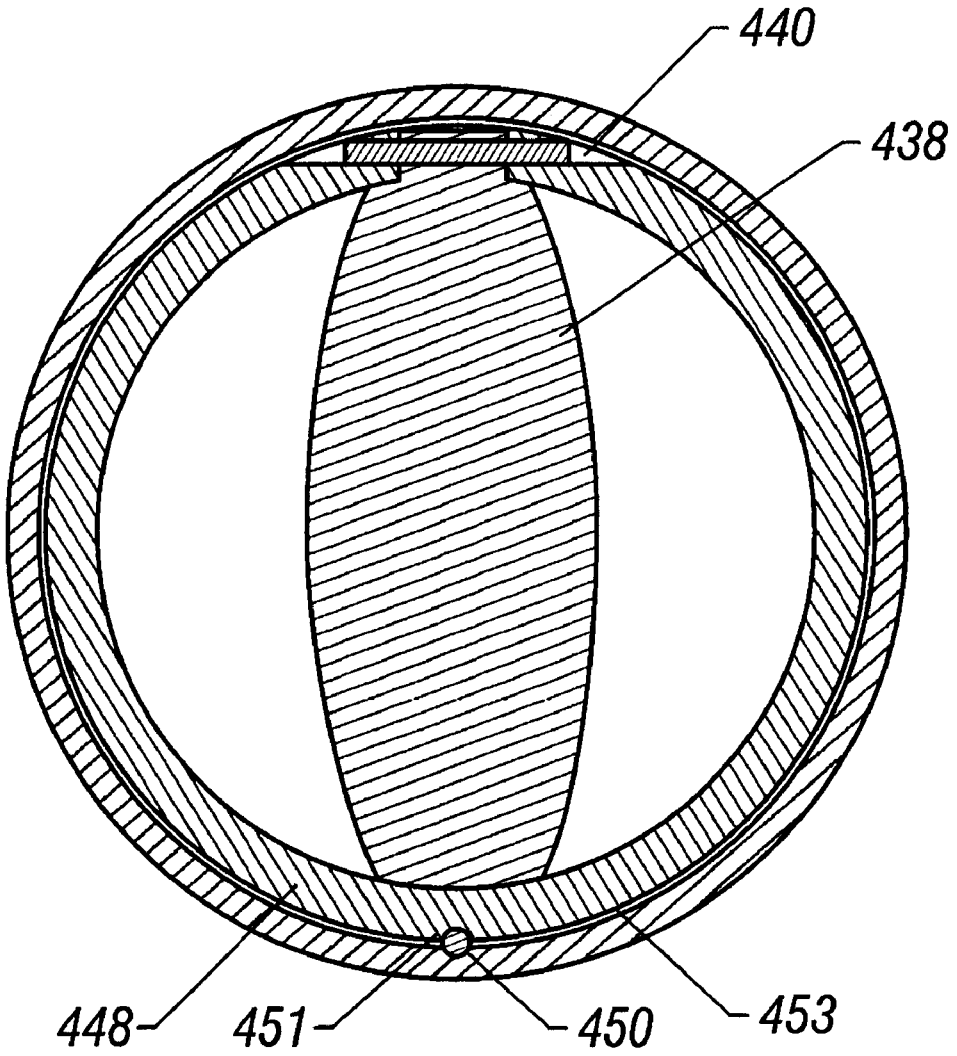
FIG. 16 is a cross-sectional view taken along line XVI—XVI of FIG. 9D.

Referring again to FIG. 9D, the flapper valve 438 further comprises a pivoting mechanism 440 similar to that of the previous embodiments. The pivoting mechanism 440 enables the flapper valve 438 to pivot from the closed position 446 to an open position 520 as shown in FIG. 10D. The flapper valve (438 in FIG. 9D) is pivotally attached to the flapper housing (448 in FIG. 9D). In an embodiment of the invention, the flapper housing (448 in FIG. 9D) is typically rotationally secured in place by a pin (450 in FIG. 16) that engages a groove (451 in FIG. 16) on an external surface (453 in FIG. 16) of the flapper housing (448 in FIG. 16). Further, in the embodiment, the flapper housing (448 in FIG. 9D) is typically axially secured in place between a retaining ring (452 in FIG. 9D) and a shoulder (455 in FIG. 9D) of the tool body (400 in FIG. 9D).

When the flapper valve is in the closed position (446 in FIG. 9D), the lower tube member (110A in FIG. 9D) is held against the flapper valve (438 in FIG. 9D) with the help of the securing mechanism 421 and since the lower tube member (110A in FIG. 9E) is also wedged between the flapper valve 438 and a shoulder 600 on body 400. The lower spring (456 in FIG. 9E) is initially at least partially compressed between an intermediate shoulder (454 in FIG. 9E) on the lower tube member (110A in FIG. 9E) and a shoulder (458 in FIG. 9E) of the tool body (400 in FIG. 9E). After the indexing system (435 in FIG. 9C) has been cycled through the predetermined number of pressure cycles (e.g., seven) and the upper tube member (108A in FIG. 10D) has moved axially upward, the lower spring (456 in FIG. 10E) begins to extend axially upward.

After the indexing system (435 in FIG. 9C) has been cycled through the predetermined number of pressure cycles, the high pressure in the internal bore (401 in FIG. 10D) acts to move the sliding indexer sleeve (416 in FIG. 10B) and the upper tube member (108 in FIG. 10D) axially upward compressing the upper spring (410 in FIG. 10A). This collective movement is enabled by the engagement between the upper spring (410 in FIG. 10A), the upper shoulder (470 in FIG. 10A) on the upper tuber member (108A in FIG. 10A), and the sliding indexer sleeve (416 in FIG. 10B). The upward movement of the upper tube member (108A in FIG. 10A) continues until the upper shoulder (470 in FIG. 10A) of the upper tube member (108A in FIG. 10A) contacts an upper seal ring (408 in FIG. 10A). At this point, the upper spring (410 in FIG. 10A) is substantially compressed between the sliding indexer sleeve (416 in FIG. 10B) and the upper shoulder (470 in FIG. 10B), and the upper tube member (108A in FIG. 10A) is in its uppermost position.

Figure 10C:
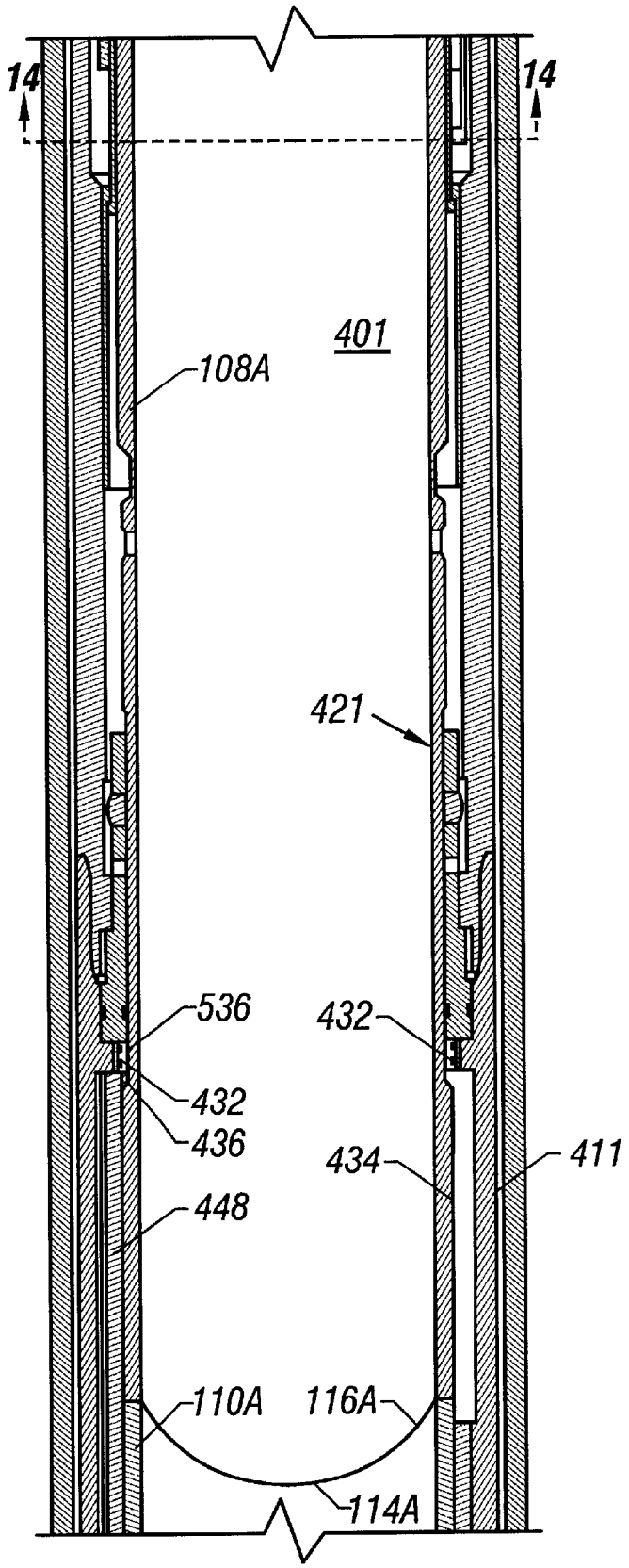
FIG. 10C is a cross-sectional view of an embodiment of a retractable valve with a flapper valve in an open position and a flow tube assembly in a tube engaging position.

In one embodiment, the upper tube member (108A in FIG. 10A) is locked in this uppermost position by a plurality of upper ratchet members (432 in FIG. 10C) comprising upper ratchet member teeth (536 in FIG. 10C) that are adapted to engage similar upper locking surface teeth (436 in FIG. 10C) formed on the upper tube member (108A in FIG. 10C). The teeth are formed so that when they are cooperatively engaged they prohibit the upper tube member (108A in FIG. 10C) from moving downward but enable the upward movement of the upper tube member 108A until it reaches its uppermost position. With the teeth engaged and the upper tube member 108A is in its uppermost position, the upper tube member (108A in FIG. 10C) is substantially secured axially in place.

It is noted that during the upward movement of the upper tube member 108A, the flapper valve (438 in FIG. 9D) and the lower tube member (110A in FIG. 9D) are maintained in their respective closed and lower positions by the pressure in the internal bore (401 in FIG. 9D) that induces the upward movement of the sliding indexer sleeve 416 and the upper tube member 108A. The pressure in the internal bore (401 in FIG. 9D) acts downwardly against the flapper valve (438 in FIG. 9D) and the lower tube member (110A in FIG. 9D).

Once the upper tube member (108A in FIG. 10C) is locked in place, the pressure in the internal bore (401 in FIG. 10D) is decreased. After the pressure is decreased so that it provides less downward force on the flapper valve (438 in FIG. 10D) than the upward force provided on the flapper valve (438 in FIG. 10D) and lower tube member (110A in FIG. 10D) by the lower spring (456 in FIG. 10E), the upward force of the lower spring (456 in FIG. 10D) pushes the lower tube member (110A in FIG. 10D) and the flapper valve (438 in FIG. 10D) upward. As the upward movement continues, the flapper valve (438 in FIG. 10D) rotates about the pivoting mechanism (440 in FIG. 10D). The rotation of the of the flapper valve (438 in FIG. 10D) moves the flapper valve (438 in FIG. 10D) into a recess (434 in FIG. 10D) in the flapper housing (448 in FIG. 10D) and moves the flapper valve (438 in FIG. 10D) into the open position (520 in FIG. 10D).

Referring to FIG. 10D, soon after the flapper valve 438 pivots into the recess 434, the top surface 116A of the lower tube member 110A moves into a cooperative engagement with the bottom surface 114A of the upper tube member 108A. The lower spring 456, which is sliding the lower tube member 110A axially upward as it expands, forces the lower tube member 110A against the upper tube member 108A. As in the previous embodiment, the bottom surface 114A of the upper tube member 108A and the top surface 116A of the lower tube member 110A are formed to cooperatively mate with each other. Sealing elements (not shown) may also be arranged around the perimeters of both the bottom surface 114A and the top surface 116A to help form a sealing engagement.

Figure 10E:
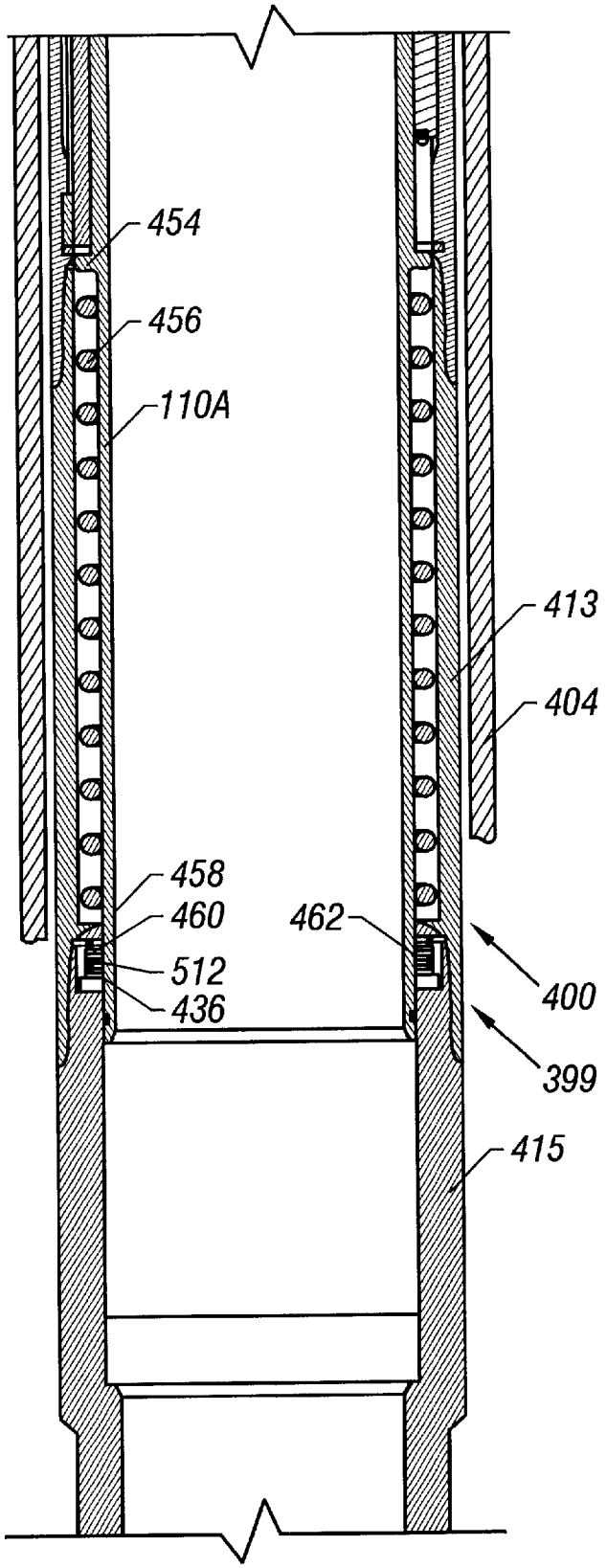
FIG. 10E is a cross-sectional view of an embodiment of a retractable valve with a flapper valve in an open position and a flow tube assembly in a tube engaging position.

In one embodiment, the lower tube member (110A in FIG. 10D) is locked in this position by a plurality of lower ratchet members (460 in FIG. 10E) comprising lower ratchet member teeth (512 in FIG. 10E) that are adapted to engage similar lower locking surface teeth (436 in FIG. 10E) formed on the lower tube member (110A in FIG. 10E). The teeth are formed so that when they are cooperatively engaged they prohibit the lower tube member (110A in FIG. 10E) from moving downward but enable the upward movement of the lower tube member (110A in FIG. 10E) until it moves into cooperative engagement against the upper tube member (108A in FIG. 10D). When the teeth are engaged and the lower tube member 110A is in cooperative engagement with upper tube member 108A, the lower tube member (110A in FIG. 10E) is substantially secured axially in place.

At this point, the upper spring (410 in FIG. 10A) is substantially compressed, the upper tube member (108A in FIG. 10A) and the lower tube member (110A in FIG. 10D) are in a cooperative engagement, and the flapper valve (438 in FIG. 10D) is located in the recess (434 in FIG. 10D). The upper ratchet members (432 in FIG. 10C) and the lower ratchet members (460 in FIG. 10C) also lock the upper tube member (108A in FIG. 10C) and the lower tube member (110A in FIG. 10E) in place. At this point, the internal bore (401 in FIG. 10D) of the downhole valve (399 in FIG. 10D) is completely free of obstructions and fluids may flow freely within the internal bore (401 in FIG. 10D).

Advantageously, the downhole valve provides a mechanism that provides a bore seal that can withstand both uphole and downhole pressure. The downole valve may be used to pressure test various downhole tubing and connections. After testing, the downhole valve may be actuated (e.g., by pressure cycles or pressure pulses) so that the flapper valve moves from a valve sealing position to an open, tube engaging position. In the tube engaging position, the downhole valve provides a bore that is free of obstructions and that permits free passage of fluids and other tools.

Those skilled in the art will appreciate that other embodiments of the invention can be devised which do not depart from the spirit of the invention as disclosed herein. Accordingly, the scope of the invention should be limited only by the attached claims.

What is claimed is:

1. A downhole valve comprising:

a body;

a flow tube assembly positioned within the body, the flow tube assembly further comprising an upper tube member and a lower tube member; and a flapper valve operatively attached to the flow tube assembly and adapted to pivot from a closed position wherein the flapper valve is sealingly positioned between the upper and lower tube members, to an open position, wherein the flapper valve is pivoted to the open position and is enclosed in a recess in the body in response to an upward movement of the upper and lower tube members so that the upper and lower tube members move into a cooperative engagement with each other to form a substantially unobstructed internal bore.

2. The downhole valve of claim 1, wherein the flapper valve further comprises:

a top surface;

a bottom surface; and an outer perimeter.

3. The downhole valve of claim 2, wherein the top surface and the bottom surface of the flapper valve have the same curvature at least proximate the outer perimeter.

4. The downhole valve of claim 2, wherein the top surface and the bottom surface of the flapper valve form an arcuate shape of uniform thickness.

5. The downhole valve of claim 2, wherein the top surface and the bottom surface of the flapper valve form an arcuate shape with at least a uniform thickness proximate the outer perimeter.

6. The downhole valve of claim 2, wherein the top surface of the flapper valve is adapted to sealingly engage a bottom surface of the upper tube member and the bottom surface of the flapper valve is adapted to sealingly engage a top surface of the lower tube member when the flapper valve is the closed position.

7. The downhole valve of claim 2, wherein the outer perimeter of the flapper valve further comprises seals adapted to sealingly engage the upper tube member and the lower tube member.

8. The downhole valve of claim 2, wherein an upper surface of the outer perimeter and a bottom surface of the outer perimeter are angled with respect to a line perpendicular to an internal bore of the body to improve the sealing engagement between the flapper valve and the upper and lower tube members.

9. The downhole valve of claim 8, wherein a bottom surface of the upper tube member and a top surface of the lower tube member are adapted to sealingly engage the angled upper and lower surfaces of the outer perimeter of the flapper valve.

10. The downhole valve of claim 1, wherein a bottom surface of the upper tube member is adapted to cooperatively engage a top surface of the lower tube member when the flapper valve is in the open position.

11. The downhole valve of claim 10, wherein at least one of the bottom surface and the top surface include a sealing element so as to provide a cooperative sealing engagement between the upper and lower tube members.

12. The downhole valve of claim 1, wherein the flapper valve is adapted to operatively move from the closed position to the open position at least partly in response to a plurality of pressurizations of an internal bore of the body.

13. The downhole valve of claim 12, wherein completion of the plurality of pressurizations of the internal bore disengages an indexing mechanism and enables the upper and lower tube members to move upward into the cooperative engagement with each other, wherein the upward movement of the upper and lower tube members enables the movement of the flapper valve from the closed position to the open position to form the substantially unobstructed wellbore.

14. The downhole valve of claim 13, wherein the indexing mechanism comprises a ratchet mechanism that substantially prevents rotational movement of a sliding indexer sleeve in a direction opposite an intended direction of rotation as the sliding indexer sleeve moves upward.

15. The downhole valve of claim 1, wherein the upper tube member and the lower tube member are operatively connected by a biasing mechanism.

16. The downhole valve of claim 15, wherein the biasing mechanism comprises at least one spring.

17. The downhole valve of claim 15, wherein the biasing mechanism forces a bottom surface of the upper tube member against a top surface of the flapper valve and a top surface of the lower tube member against a bottom surface of the flapper valve when the flapper valve is in the closed position.

18. The downhole valve of claim 15, wherein the biasing mechanism forces a bottom surface of the upper tube member into a cooperative engagement with a top surface of the lower tube member when the flapper valve is in the open position.

19. The downhole valve of claim 1, wherein the flapper valve is pivotally connected to a flapper housing that is axially fixed in relation to the body.

20. The downhole valve of claim 1, wherein the flapper valve is adapted to seal against pressure adjacent both a top surface and a bottom surface of the flapper valve.

21. The downhole valve of claim 1, wherein the upward sliding movement of the upper and lower tube members is induced at least in part by the pressurization of the internal bore of the body.

22. The downhole valve of claim 1, wherein the downhole valve further comprises ratchet members that axially secure the upper tube member and the lower tube member when the flapper valve is in the open position.

23. The downhole valve of claim 1, wherein the upward movement of the upper tube member is induced by the pressurization of the internal bore of the body and the upward movement of the lower tube member is induced by the expansion of a spring.

24. A downhole valve comprising:

a body;

an upper tube member slidably disposed within the body;

a lower tube member slidably disposed within the body; and a flapper valve pivotally attached to the body and adapted to sealingly engage the upper tube member and the lower tube member when in a closed position, wherein the flapper valve when in the closed position seals a bore in the body against both uphole and downhole pressure, and wherein the flapper valve is adapted to move into an open position and is enclosed in a recess in the body in response to an upward movement of the upper and lower tube members so that the upper and lower tube members slidably move into a cooperative engagement with each other to form a substantially unobstructed internal bore.

25. A downhole valve comprising:

a body;

a flow tube assembly positioned within the body, the flow tube assembly further comprising an upper tube member and a lower tube member; and a flapper valve operatively attached to the flow tube assembly and axially fixed in relation to the body, wherein the flapper valve is adapted to pivot from a closed position wherein the flapper valve is sealingly positioned between the upper and lower tube members, to an open position, wherein the flapper valve is pivoted to the open position and is enclosed in a recess in the body in response to an upward movement of the upper and lower tube members so that the upper and lower tube members move into a cooperative engagement with each other to form a substantially unobstructed internal bore.

26. A downhole valve comprising:

a body;

a flow tube assembly positioned within the body, the flow tube assembly further comprising an upper tube member and a lower tube member; and a flapper valve operatively attached to the flow tube assembly and adapted to pivot from a closed position wherein the flapper valve is sealingly positioned between the upper and lower tube members, to an open position, wherein the flapper valve is pivoted to the open position and is enclosed in a recess in the body in response to an upward movement of the upper tube member and a movement of the lower tube member so that the upper and lower tube members move into a cooperative engagement with each other to form a substantially unobstructed internal bore and the flapper valve is retained in the open position by the lower tube member.

27. The downhole valve of claim 26, wherein the lower tube member also moves upwards.

28. A method of selectively sealing a bore of a body, the method comprising:

pivotally attaching a flapper valve to the body;

sealingly engaging a top surface of the flapper valve with an upper tube member when the flapper valve is in a closed position;

sealingly engaging a bottom surface of the flapper valve with a lower tube member when the flapper valve is in the closed position; and moving the flapper valve from the closed position to an open position by slidably moving the upper tube member and the lower tube member upward until the flapper valve is enclosed in a recess in the body and the upper tube member cooperatively engages the lower tube member.

29. The method of claim 28, wherein the moving step is at least partly in response to a plurality of pressure cycles.

30. The method of claim 28, further comprising sealing the bore from pressure both uphole and downhole of the flapper valve when the flapper valve is in the closed position.

31. The method of claim 28, further comprising axially securing the upper and lower tube members when they are cooperatively engaged with each other.

32. The method of claim 31, wherein the axially securing step comprises axially securing the upper tube member with a mechanism that is functionally independent from the mechanism that axially secures the lower tube member.

33. The method of claim 28, further comprising axially securing the flapper valve in position relative to the body.

34. The method of claim 28, wherein the upper tube member and the lower tube member slidably move substantially upward from an initial position as the flapper valve moves from the closed position to the open position.

35. The method of claim 29, wherein completing the plurality of pressure cycles disengages an indexing mechanism and allows the upper and lower tube members to move axially upward, wherein the upward movement of the upper and lower tube members moves the flapper valve from the closed position to the open position.

36. The method of claim 28, wherein the upper tube member is moved upward by the continued pressurization of the internal bore of the body.

37. The method of claim 36, wherein the lower tube member is moved upward by the expansion of a spring.

38. The method of claim 37, wherein the spring does not expand until the pressurization of the internal bore is decreased.

39. The method of claim 37, wherein the upper tube member is locked in its uppermost position prior to the movement of the lower tube member.

40. The method of claim 39, wherein the lower tube member is locked in cooperative engagement with the upper tube member using a mechanism that is functionally independent from the mechanism that locks the upper tube member in its uppermost position.

41. The method of claim 28, wherein the cooperative engagement between the upper and lower tube members is a cooperative sealing engagement.

42. A method of selectively sealing a bore of a body, the method comprising:

pivotally attaching a flapper valve to the body;

sealingly engaging a top surface of the flapper valve with an upper tube member when the flapper valve is in a closed position;

sealingly engaging a bottom surface of the flapper valve with a lower tube member when the flapper valve is in the closed position; and pressurizing the internal bore of the body to move the upper tube member upwards;

expanding a spring to move the lower tube member upwards; and moving the flapper valve from the closed position to an open position in response to the upwards movement of the upper tube member and the lower tube member.

43. The method of claim 42, wherein the expanding step occurs subsequent to the pressurizing step.

44. The method of claim 42, further comprising locking the upper tube member and the lower tube member so that they are cooperatively engaged.

45. The method of claim 44, wherein the locking step occurs when the upper tube member and the lower tube member are in their uppermost positions.

46. The method of claim 44, further comprising locking the upper tube member with a mechanism that is functionally independent from the mechanism used to lock the lower tube member.

47. A downhole valve, comprising:

a body;

a flow tube assembly positioned within the body, the flow tube assembly further comprising an upper tube member and a lower tube member; and a flapper valve operatively attached to the flow tube assembly and adapted to pivot from a closed position wherein the flapper valve is sealingly positioned between the upper and lower tube members, to an open position, wherein the flapper valve is pivoted to the open position and is enclosed in a recess in the body in response to the movement of the upper and lower tube members in a single direction so that the upper and lower tube members move into a cooperative engagement with each other to form a substantially unobstructed internal bore.

48. The downhole valve of claim 47, wherein the single direction is the upwards direction.

49. The downhole valve of claim 48, wherein the upper tube member and the lower tube member are locked in their uppermost positions.

50. The downhole valve of claim 47, wherein the upper tube member and the lower tube member are locked following movement in the single direction.

51. A method of selectively sealing a bore of a body, the method comprising:

pivotally attaching a flapper valve to the body;

sealingly engaging a top surface of the flapper valve with an upper tube member when the flapper valve is in a closed position;

sealingly engaging a bottom surface of the flapper valve with a lower tube member when the flapper valve is in the closed position; and moving the flapper valve from the closed position to an open position by slidably moving the upper tube member and the lower tube member in a single direction until the flapper valve is enclosed in a recess in the body and the upper tube member cooperatively engages the lower tube member.

52. The method of claim 51, wherein the single direction is the upwards direction.

53. The method of claim 52, further comprising locking the upper tube member and the lower tube member in their uppermost positions.

54. The downhole valve of claim 51, further comprising locking the upper tube member and the lower tube member following movement in the single direction.

* * * * *